US007791635B2

(12) United States Patent
Ogawa et al.

(10) Patent No.: US 7,791,635 B2
(45) Date of Patent: Sep. 7, 2010

(54) IMAGE FORMING APPARATUS AND IMAGE FORMING METHOD

(75) Inventors: Yoshiko Ogawa, Osaka (JP); Akihiro Kawasaki, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 12/341,106

(22) Filed: Dec. 22, 2008

(65) Prior Publication Data

US 2009/0176171 A1 Jul. 9, 2009

(30) Foreign Application Priority Data

Jan. 9, 2008 (JP) ..... 2008-002109

(51) Int. Cl.
*B41J 2/47* (2006.01)

(52) U.S. Cl. ..... 347/252

(58) Field of Classification Search ..... 347/131, 347/133, 195, 240, 251–254; 358/444, 448
See application file for complete search history.

(56) References Cited

U.S. PATENT DOCUMENTS 4,816,843 A * 3/1989 Sasaki ..... 347/195
6,239,824 B1 * 5/2001 Mutou et al. ..... 347/131
7,428,400 B2 9/2008 Iwakura et al.
2005/0024468 A1 * 2/2005 Ohba et al. ..... 347/133
2006/0210326 A1 9/2006 Takehara et al.
2006/0222389 A1 * 10/2006 Kin et al. ..... 399/49
2006/0257176 A1 11/2006 Kawasaki et al.
2006/0280529 A1 12/2006 Nakagawa et al.
2008/0075480 A1 3/2008 Konishi et al.
2008/0199792 A1 8/2008 Kawasaki et al.
2008/0267641 A1 10/2008 Konishi et al.

FOREIGN PATENT DOCUMENTS

JP 2002-292929 10/2002

* cited by examiner

*Primary Examiner*—Hai C Pham
(74) *Attorney, Agent, or Firm*—Oblon, Spivak, McClelland, Maier & Neustadt, L.L.P.

(57) ABSTRACT

In a disclosed image forming apparatus, a developing bias applied to a developer carrier or exposure energy with which an image carrier is exposed is adjusted such that an isolated one-dot image on the image carrier has a predetermined image density. When the image carrier is exposed to form dot images continuously arranged in a sub scanning direction, the exposure time period for each dot image is shorter than a time period for exposing the image carrier to form the isolated one-dot image.

9 Claims, 18 Drawing Sheets

IMAGE FORMING APPARATUS AND IMAGE FORMING METHOD

BACKGROUND OF THE INVENTION

1. Field of the Invention

The present invention relates to an image forming apparatus such as a printer, a facsimile machine, and a copier, and an image forming method.

2. Description of the Related Art

Image forming apparatuses such as low-cost laser-beam printers employ a contact-type developing method performed with the use of a one-component developer. With this method, the image forming apparatus can have a simple structure and power source costs can be reduced. In the contact-type developing method performed with the use of a one-component developer, no gap is formed at the developing nip between a photoconductor, which acts as a latent image carrier, and toner. Therefore, in this method, a wraparound electric field is not generated, unlike the case of using a two-component developer (hereinafter, "two-component developing") or using a one-component developer in a non-contact-type developing method (hereinafter, "one-component non-contact developing"). Accordingly, in the contact-type developing method performed with the use of a one-component developer, an edge effect does not occur as much as in the case of two-component developing or one-component non-contact developing; hence, the latent image can be precisely developed.

When light is radiated onto a photoconductor to form an isolated one-dot image, the latent image electric potential distribution is substantially a Gaussian distribution (normal distribution). In the case of two-component developing or one-component non-contact developing, an edge effect occurs, and therefore an isolated one-dot image can be reproduced with a weak laser beam. However, in the case of a contact-type developing method performed with the use of a non-magnetic one-component developer, a wraparound electric field is not generated, and therefore an isolated one-dot image cannot be properly reproduced with a laser beam having the same intensity as that used in two-component developing or one-component non-contact developing.

FIG. 15 shows the conventional area gradation and the area gradation when the laser beam is intensified.

Area gradation is described with reference to FIG. 16. In a matrix of 4 dots (pixels)×4 dots (pixels)=16 dots (pixels), a first gradation level is expressed by forming an image at one portion (one dot) of the 16 dot matrix. As the gradation level increases, the 16 dot matrix has more portions including dot images. At a sixteenth gradation level, the entire 16 dot matrix is filled with dot images. As shown in FIG. 16, the matrix includes a region corresponding to dot images (the black portions in the figure) and a region corresponding to non-image dots (the white portions in the figure). However, in reality, an error diffusion method is employed to disperse the image dots and the non-image dots.

As indicated by a line joining ◇ marks in the graph shown in FIG. 15, the low density portions in area gradation including isolated one-dot images have a lower density than the ideal density.

In order to enhance the reproducibility of isolated one-dot images, various measures are taken, such as intensifying the laser beam or adjusting the developing bias (see, for example, Patent Document 1).

Patent Document 1: Japanese Laid-Open Patent Application No. 2002-292929

If the laser beam is intensified in an attempt to enhance the reproducibility of isolated one-dot images, the following problem arises. That is, gradation loss (change) occurs (portions that are supposed to be blank are developed) in high density portions of the area gradation, as indicated by a line joining ● marks in the graph shown in FIG. 15.

In FIG. 17, (a) illustrates an example of potentials on a photoconductor surface at a low density portion in the area gradation and corresponding dot images. In FIG. 17, (b) illustrates an example of potentials on a photoconductor surface at a high density portion in the area gradation and corresponding dot images.

As shown in (a) of FIG. 17, at a low density portion in the area gradation, non-image dots are continuously arranged, and each dot image is isolated. In such a case, by intensifying the laser beam, the reproducibility of one-dot images can be enhanced so that favorable gradation properties are attained.

As shown in (b) of FIG. 17, at a high density portion in the area gradation, dot images are continuously arranged, and each non-image dot is isolated. The laser beam has been intensified in an attempt to enhance reproducibility of isolated one-dot images. Thus, if each dot image on either side of the isolated non-image dot is formed by exposure, the potential of the isolated non-image dot is attenuated. As a result, each of the isolated non-image dots has a potential (potential of exposed portions) that is lower than the developing bias, and the isolated non-image dots are developed (i.e., portions corresponding to isolated non-image dots, which are supposed to be blank, appear as dot images in the developed image). In this manner, gradation loss (change) may occur in high density portions of the area gradation.

Another method of enhancing reproducibility of isolated one-dot images is to adjust the developing bias.

FIG. 18 illustrates an example in which the developing bias is adjusted to enhance the reproducibility of isolated one-dot images.

As shown in (a) of FIG. 18, in order to enhance the reproducibility of isolated one-dot images by adjusting the developing bias, the latent image region is developed with the use of the developing bias ②, which is closer to the potential of unexposed portions of the photoconductor than the conventional developing bias (developing bias ①). Accordingly, the developed latent image region can be made to have a width of one dot, thereby enhancing the reproducibility of isolated one-dot images.

Furthermore, if the developing bias is adjusted to enhance the reproducibility of isolated one-dot images, the width of a latent image potential distribution on the surface of a photoconductor will be narrower compared to the case of intensifying laser beams. Thus, as shown in (b) of FIG. 18, at each isolated non-image dot, the latent image potentials that are adjacent to the isolated non-image dot (on either side) in the sub scanning direction are not overlapping each other. Therefore, the potential at the non-image dot does not become as low as the potential of the exposed portions. As a result, gradation loss (change) does not occur in high density portions of the area gradation.

However, even by adjusting the developing bias, the potential on the photoconductor surface significantly attenuates at portions where dot images are continuously arranged, as the latent image potentials that are adjacent to the isolated non-image dot (on either side) in the sub scanning direction overlap each other (although the potential in this case does not attenuate as much as that in the case of intensifying the laser beam). In the case of adjusting the developing bias to enhance the reproducibility of isolated one-dot images, the developing bias is made to be closer to the potential of unexposed portions of the photoconductor. For this reason, the difference between the potential of exposed portions of the photoconductor surface and the developing bias (developing potential) becomes large. As a result, at portions where dot images are continuously arranged, the toner density becomes high (dark). Thus, there has been a problem in that the image density becomes high (dark) at mid-density portions to high density portions in the area gradation where dot images are continuously arranged.

SUMMARY OF THE INVENTION

The present invention provides an image forming apparatus and an image forming method in which one or more of the above-described disadvantages are eliminated.

A preferred embodiment of the present invention provides an image forming apparatus and an image forming method in which area gradation properties are enhanced in a contact-type developing method performed with the use of a non-magnetic one-component developer.

According to an aspect of the present invention, there is provided an image forming apparatus including an image carrier; an exposing unit configured to form an electrostatic latent image including dot images based on image data, by exposing a surface of the image carrier with exposure energy in accordance with pixels in the image data, wherein each of the dot images corresponds to one of the pixels; and a developing unit configured to perform a developer contact developing method by applying a developing bias onto a developer carrier carrying a non-magnetic one-component developer and causing the non-magnetic one-component developer on the developer carrier to contact the image carrier, thereby developing the electrostatic latent image on the image carrier into a toner image, wherein the toner image on the image carrier is transferred onto a recording material, either directly or via a surface of an intermediate transfer body; and the developing bias or the exposure energy is adjusted such that an isolated one-dot image has a predetermined image density, the image forming apparatus further including a control unit configured to control the exposing unit in such a manner that, when the image carrier is exposed to form the dot images which are continuously arranged in a sub scanning direction, an exposure time period for each of the dot images is shorter than a time period for exposing the image carrier to form the isolated one-dot image.

According to an aspect of the present invention, there is provided an image forming method including the steps of forming a latent image on a surface of an image carrier by exposing the surface of the image carrier based on input image data corresponding to dot images; and developing the latent image on the image carrier by performing a developer contact developing method with the use of a non-magnetic one-component developer, wherein when the image carrier is exposed to form the dot images continuously arranged in a sub scanning direction, an exposure time period is shorter than a time period for exposing the image carrier to form an isolated one-dot image.

According to one embodiment of the present invention, an image forming apparatus and an image forming method are provided, in which area gradation properties are enhanced in a contact-type developing method performed with the use of a non-magnetic one-component developer.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

A description is given, with reference to the accompanying drawings, of embodiments of the present invention.

A description is given of an embodiment of the present invention applied to a printer 100, which is an image forming apparatus.

Figure 1:
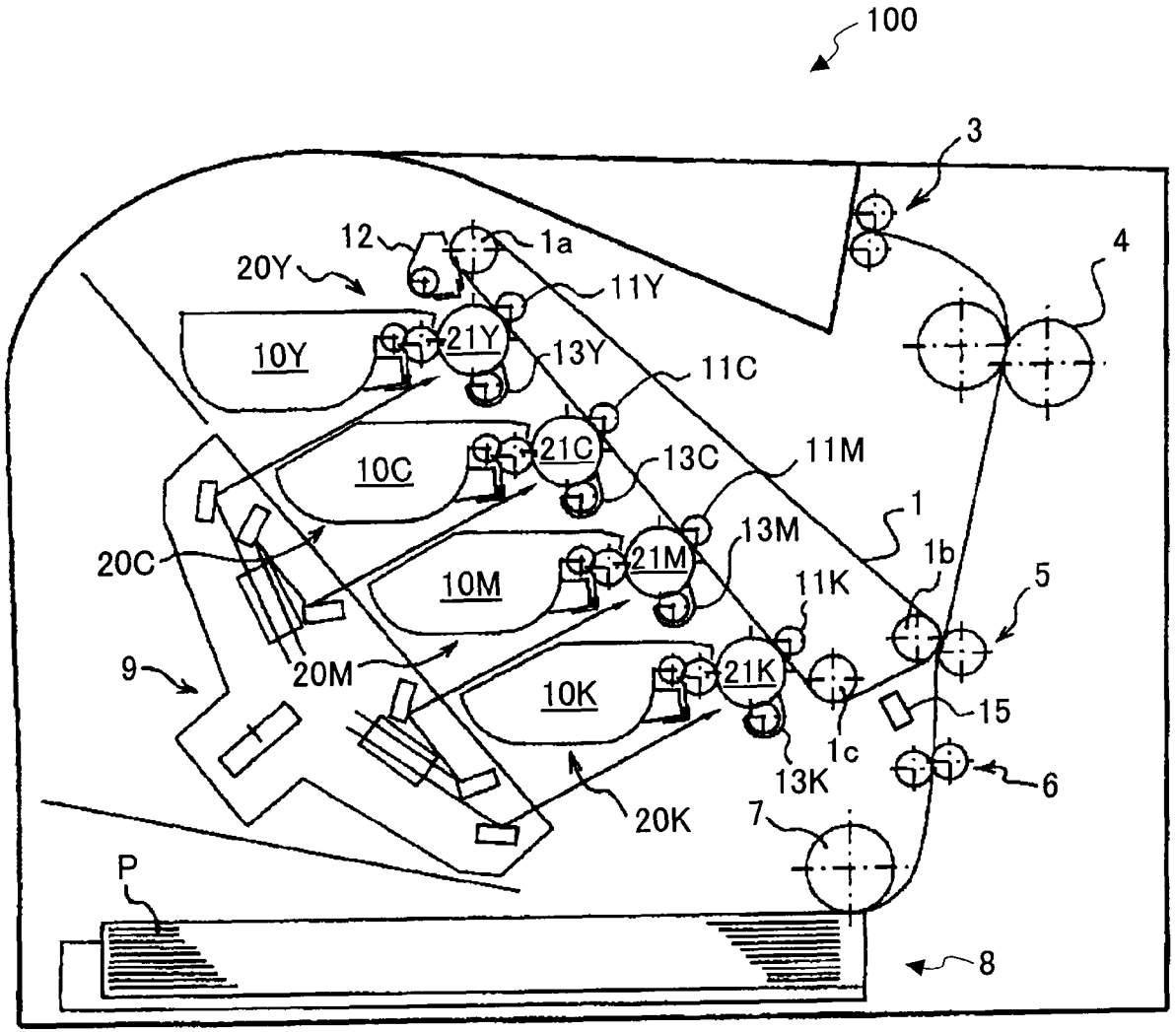
FIG. 1 is a schematic diagram of an image forming apparatus according to an embodiment of the present invention.

First, a description is given of the overall configuration and operation of the printer 100 according to an embodiment of the present invention, with reference to FIG. 1.

The printer 100 includes a tandem image forming section with four image forming stations arranged in an oblique manner, corresponding to yellow, cyan, magenta, and black. In the tandem image forming section, toner image forming units 20Y, 20C, 20M, and 20K, which are individual toner image forming units, are arranged in the stated order starting from the top left when viewed in the figure. The letters Y, C, M, and K accompanying the reference numerals indicate that the corresponding members are for yellow, magenta, cyan, and black, respectively. In the tandem image forming section, the toner image forming units 20Y, 20C, 20M, and 20K include photoconductive drums 21Y, 21C, 21M, and 21K (photoconductors), respectively, which photoconductive drums are drum-type image carriers. The photoconductive drums 21Y, 21C, 21M, and 21K are surrounded by charging devices 13Y, 13C, 13M, and 13K, developing devices 10Y, 10C, 10M, and 10K acting as developing units, and photoconductor cleaning devices, respectively.

An optical writing unit 9 acting as an exposing unit is provided beneath the tandem image forming section. The optical writing unit 9 includes a light source, polygon mirrors, f-θ lenses, and reflection mirrors. The optical writing unit 9 is configured to scan the surface of each of the photoconductive drums 21 by radiating laser beams based on image data.

An intermediate transfer belt 1 is provided along the obliquely-arranged tandem image forming section, which intermediate transfer belt 1 is an endless belt acting as an intermediate transfer body. The intermediate transfer belt 1 is wound around supporting rollers 1*a*, 1*b*, and 1*c*. Among these, the supporting roller 1*a* acts as a driving roller, and a not shown driving motor acting as a driving source is connected to the rotational shaft of the driving roller 1*a*. When this driving motor is driven, the intermediate transfer belt 1 rotates in a counterclockwise direction when viewed in the figure, and the supporting rollers 1*b* and 1*c* rotate following the rotation of the intermediate transfer belt 1. Primary transfer devices 11Y, 11C, 11M, and 11K are provided on the inside of the intermediate transfer belt 1 for transferring toner images formed on the respective photoconductive drums 21Y, 21C, 21M, and 21K onto the intermediate transfer belt 1.

A reflective-type optical sensor 15, acting as a toner density detecting unit, is disposed at a position facing the surface of the intermediate transfer belt 1. The optical sensor 15 detects the optical reflectance of a toner image on the intermediate transfer belt 1. Based on the detection results, the amount of adhering toner is obtained, and image forming process conditions such as a charging bias, a developing bias, and an exposure amount are changed accordingly.

A secondary transfer roller 5 acting as a secondary transfer device is provided at a downstream position with respect to the primary transfer devices 11Y, 11C, 11M, and 11K, in the driving direction of the intermediate transfer belt 1. The supporting roller 1*b* is arranged opposite to the secondary transfer roller 5 across the intermediate transfer belt 1, which supporting roller 1*b* functions as a pressing member. Furthermore, a sheet feeding cassette 8, a sheet feeding roller 7, and a pair of registration rollers 6 are provided. The secondary transfer roller 5 transfers a toner image onto a transfer sheet P acting as a recording medium. At downstream positions of the secondary transfer roller 5, there are provided a fixing unit 4 for fixing the image on the transfer sheet P, and sheet eject rollers 3.

Next, operations of the printer 100 are described. In each image forming station, the corresponding photoconductive drum 21Y, 21C, 21M, or 21K is rotated. As the photoconductive drums 21Y, 21C, 21M, and 21K are rotated, first, the charging devices 13Y, 13C, 13M, and 13K uniformly charge the surfaces of the photoconductive drums 21Y, 21C, 21M, and 21K. Next, the optical writing unit 9 performs optical writing by radiating laser beams corresponding to image data, thereby forming electrostatic latent images on the photoconductive drums 21Y, 21C, 21M, and 21K. Subsequently, toner is caused to adhere onto the electrostatic latent images by the developing devices 10Y, 10C, 10M, and 10K, and therefore the electrostatic latent images are turned into visible images. Accordingly, monochrome images of yellow, cyan, magenta, and black are formed on the photoconductive drums 21Y, 21C, 21M, and 21K, respectively. As the not-shown driving motor rotates the driving roller 1*a* so that the intermediate transfer belt 1 rotates, and the supporting rollers 1*b* and 1*c* and the secondary transfer roller 5 follow the rotation of the driving roller 1*a*, the visible images are sequentially transferred and superposed onto the intermediate transfer belt 1 by the primary transfer devices 11Y, 11C, 11M, and 11K. As a result, a composite color image is formed on the intermediate transfer belt 1. After the images have been transferred, photoconductor cleaning devices clean the surfaces of the photoconductive drums 21Y, 21C, 21M, and 21K by removing the remaining toner, to be prepared for the next image forming operation.

At the timing of forming an image, the leading edge of the transfer sheet P is delivered from the sheet feeding cassette 8 by the sheet feeding roller 7 and conveyed to the registration rollers 6, where the transfer sheet P temporarily stops. In synchronization with the timing of the image forming operation, the transfer sheet P is conveyed in between the secondary transfer roller 5 and the intermediate transfer belt 1. The transfer sheet P is sandwiched by the intermediate transfer belt 1 and the secondary transfer roller 5, thus forming a secondary transfer nip. At the secondary transfer roller 5, the toner image on the intermediate transfer belt 1 is transferred onto the transfer sheet P by a secondary transfer operation.

The transfer sheet P onto which the image has been transferred is sent to the fixing unit 4. The fixing unit 4 applies heat and pressure onto the transfer sheet P to fix the transferred image. Then, the transfer sheet P is ejected outside of the apparatus. After the image has been transferred from the transfer belt 1 onto the transfer sheet P, an intermediate transfer body cleaning device 12 removes remaining toner from the intermediate transfer belt 1, to be prepared for the next image forming operation performed by the tandem image forming section.

The toner image forming units 20Y, 20C, 20M, and 20K corresponding to respective colors are integrated into a single unit, forming a process cartridge that is detachably attached to the main unit. This integral process cartridge can be drawn out toward the front of the main body of the printer 100 along not shown guide rails fixed to the main body of the printer 100. By pressing the process cartridge into the back of the main body of the printer 100, the toner image forming units 20Y, 20C, 20M, and 20K are loaded into predetermined positions.

Figure 2:
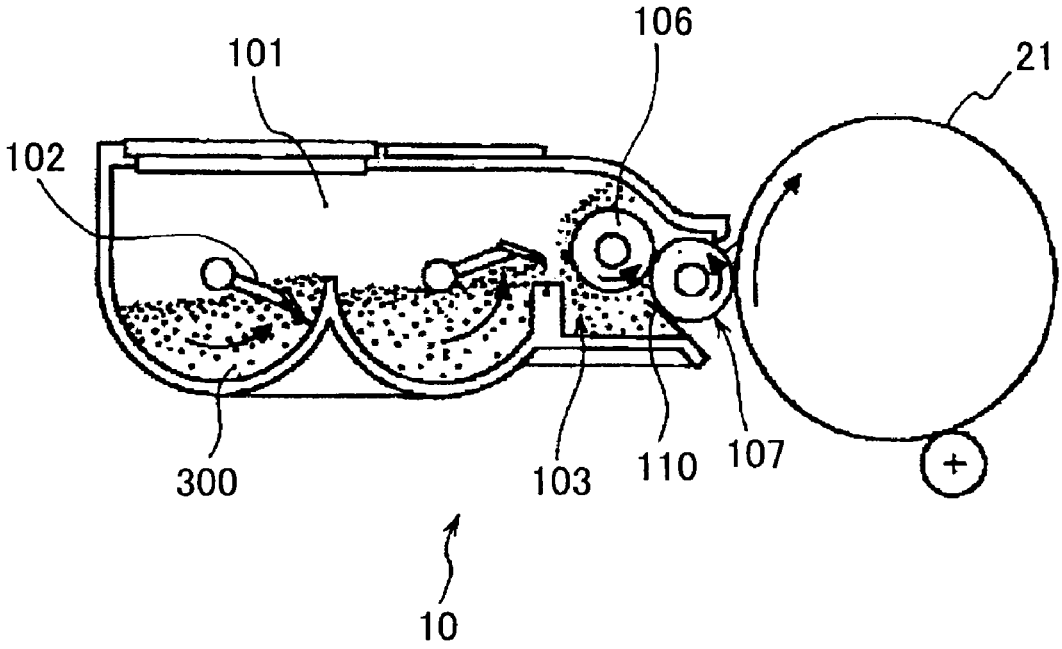
FIG. 2 is a schematic diagram of a developing device.

FIG. 2 is a schematic diagram of one of the developing devices 10. The developing device 10 is disposed in such a manner as to contact the photoconductive drum 21. The developing device 10 includes a developing roller 107 acting as a developer carrier for providing toner onto the photoconductive drum 21 to develop an image, a supplying roller 106 disposed in such a manner as to abut the developing roller 107, a toner layer restricting member 110, and a toner storage chamber 101 for storing non-magnetic one-component toner 300.

The non-magnetic one-component toner 300 in the toner storage chamber 101 is moved by toner conveying members 102 to a toner supply chamber 103. The one-component toner 300 that has been moved to the toner supply chamber 103 adheres to the surface of the supplying roller 106, and is then applied to the surface of the developing roller 107. The amount of toner applied to the developing roller 107 is controlled by the toner layer restricting member 110 so that a thin toner layer is formed. As the developing roller 107 rotates, the toner, which has become a thin layer on the surface of the developing roller 107 due to control of the toner layer restricting member 110, is then conveyed to the developing position that faces the photoconductive drum 21. According to a developing bias applied to the developing roller 107 and a latent image electric field created due to the electrostatic latent image on the photoconductive drum 21, the toner is then moved onto the surface of the photoconductive drum 21 to develop the latent image.

Figure 3:
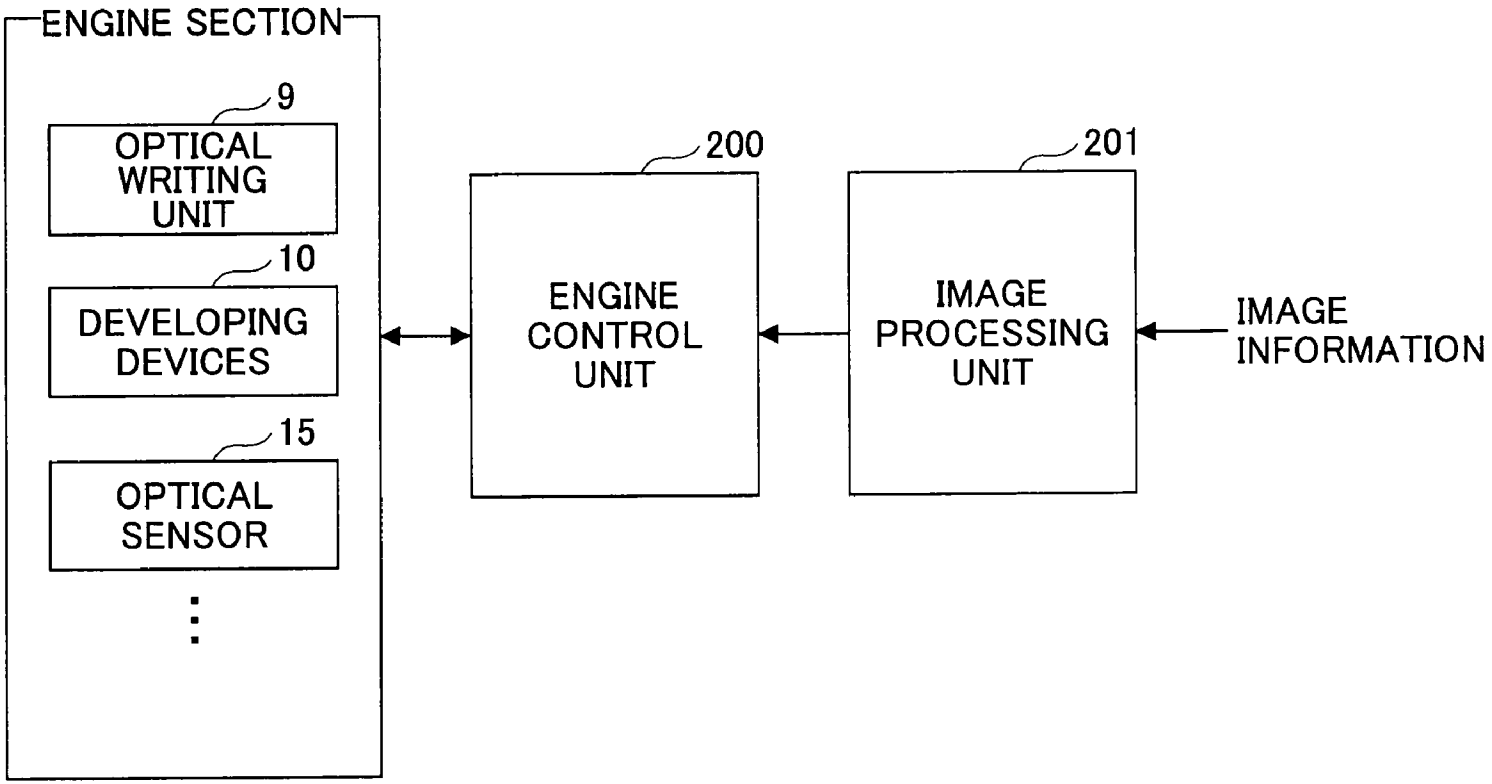
FIG. 3 is a functional block diagram of control units for controlling the image forming apparatus.

FIG. 3 is a block diagram of an electric connection of units in the image forming apparatus (printer 100). The image forming apparatus according to an embodiment of the present invention includes a control section acting as a control unit. The control unit includes an engine control unit 200 for controlling the driving operation of the photoconductors (photoconductive drums 21), the developing devices 10, the optical writing unit 9, etc., and an image processing unit 201 for performing processes such as converting image information input from a personal computer (PC), etc., into digital signals.

The image information from the personal computer (PC) undergoes a predetermined digital signal process in the image processing unit 201, and image data based on the digital signals obtained by the process is then temporarily saved in an image storing unit. The image processing unit 201 performs digital signal processes such as a shading correction process, a filtering process, a γ correction process, and a graduation process, and image data to be output is then sent to the engine control unit 200.

The engine control unit 200, which has received the image data to be output sent from the image processing unit 201, drives/controls the sheet feeding device and the photoconductive drums 21, etc., by providing driving signals to driving motors, clutches, and solenoids that act as driving sources of their movable portions; the engine control unit 200 also drives/controls the charging devices 13 and the developing devices 10 by providing driving signals to their high voltage power supply circuits.

The engine control unit 200 receives the image data to be output (obtained as a result of the image process), and stores the image data in a line memory. The engine control unit 200 sends the data corresponding to pixels (dots) from the line memory at a predetermined timing (pixel clock) to the optical writing unit 9, in such a manner as to coincide with signals in synchronization with rotation of the polygon mirror (so-called synchronization signals). In the optical writing unit 9, this data is converted into signals to drive a laser diode. The engine control unit 200 searches the data in the line memory for portions where dot image data is continuously arranged in the sub scanning direction, and delays the timing of sending the dot image data that is continuously arranged in the sub scanning direction to the optical writing unit 9, so that the exposing time is reduced.

The light from the laser diode forms parallel rays at a collimation lens, and an aperture cuts the parallel rays into a light beam having a desired beam diameter. The light beam that has passed through the aperture passes through a cylindrical lens, and is incident on the polygon mirror. The light beam reflected from the polygon mirror is condensed by a scanning lens (f-θ lens), turned around by a turn-around mirror, and focused on the surface of the photoconductive drum 21. Accordingly, an electrostatic latent image is formed on the surface of the photoconductive drum 21, and toner adheres to the electrostatic latent image so that a toner image is formed.

Next, a description is given of characteristics of the present embodiment.

In the present embodiment, in order to optimize the density of an isolated one-dot image, which has the lowest density in area gradation in the contact-type developing method performed with the use of a non-magnetic one-component developer, the following measure is taken. That is, the difference between the potential of exposed portions of the photoconductor and the developing bias (i.e., the developing potential) is made higher than that of the conventional case of using the two-component developer or the one-component non-contact developer. Specifically, as indicated by a line joining ■ marks in the graph shown in FIG. 4, the developing bias is adjusted in such a manner that the density of an isolated one-dot image corresponds to an ideal value of 0.1. Accordingly, properties of the isolated one-dot image can be stabilized. However, the density at mid-density portions to high density portions in the area gradation becomes higher than the ideal density indicated by the solid line.

Accordingly, in the present embodiment, in order to optimize the image densities at mid-density portions to high density portions in the area gradation and to attain preferable area gradation properties, the exposure time of each pixel (dot), i.e., the time of exposing a photoconductor with light beams to form a dot image, is changed according to the exposure pixel data (hereinafter, "dot image") continuously arranged in the sub scanning direction.

Details are described below in practical examples 1 through 5.

Practical Example 1

First, a description is given of practical example 1.

Figure 5:
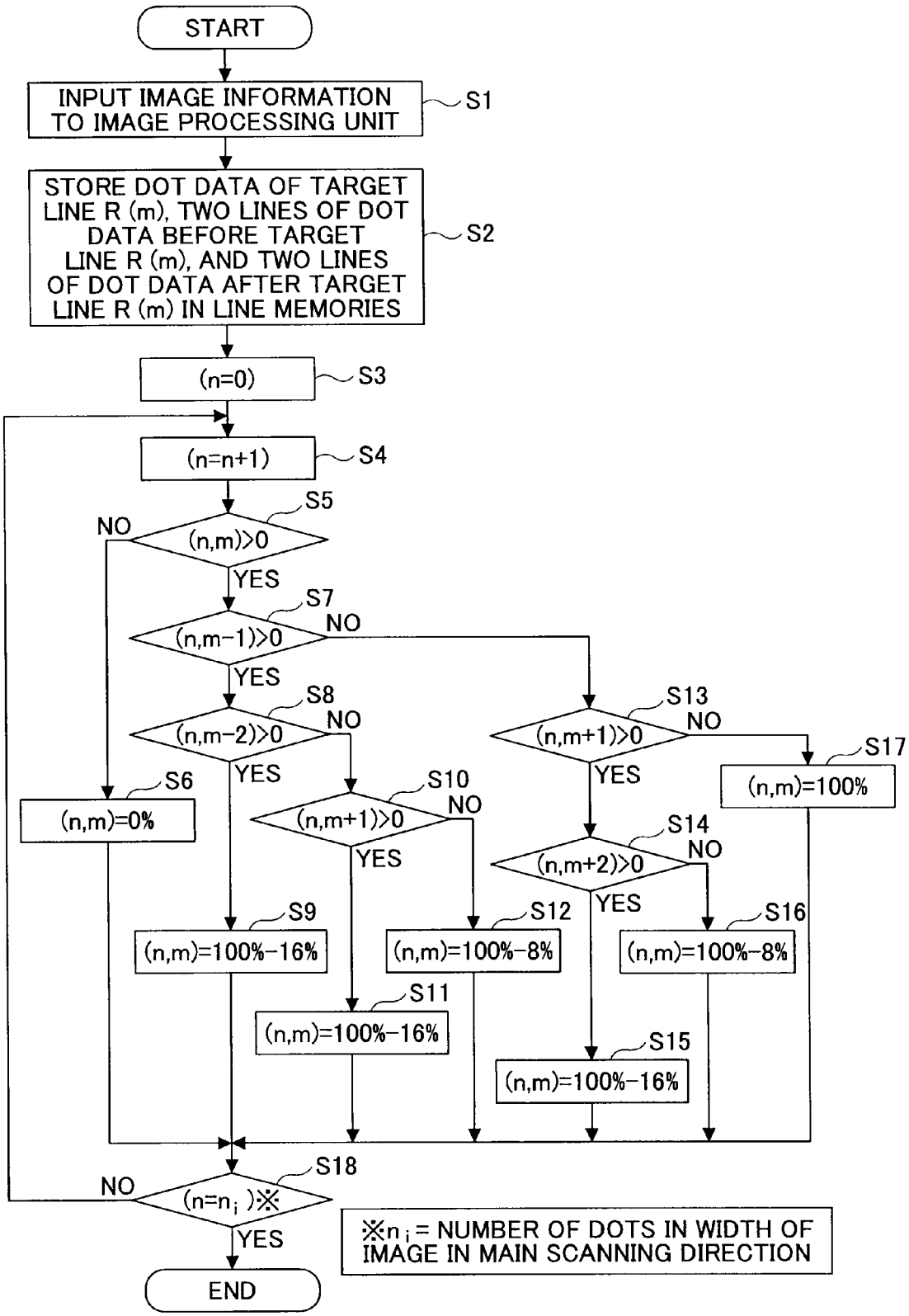
FIG. 5 is a control flowchart of procedures for determining the exposure time for each pixel (dot) according to practical example 1.
Figure 6:
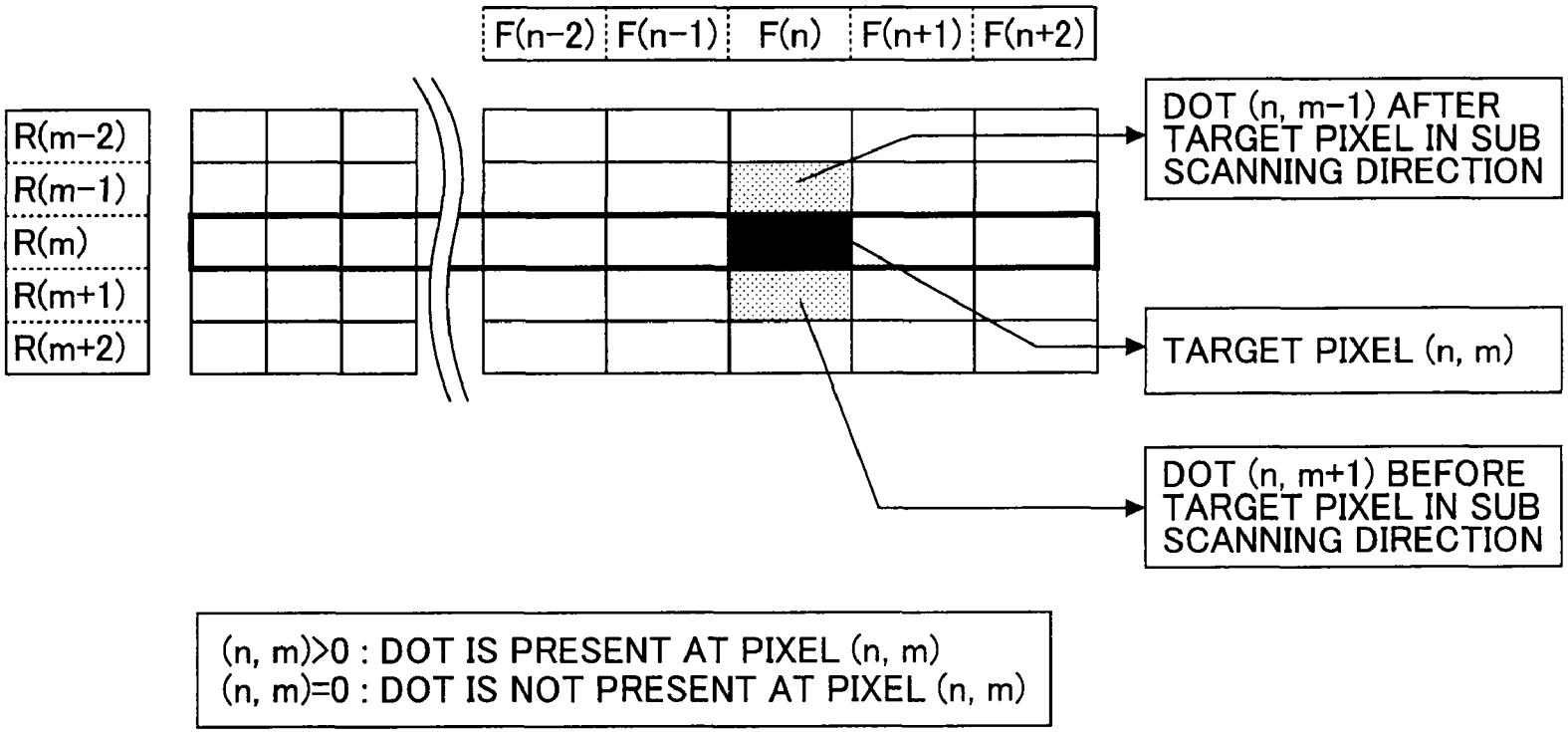
FIG. 6 illustrates the procedure of determining the exposure time for each pixel (dot) according to practical example 1.

FIG. 5 is a control flowchart of procedures for determining the exposure time for each pixel (dot) according to practical example 1. FIG. 6 illustrates the procedure of determining the exposure time for each pixel (dot) according to practical example 1.

As shown in FIG. 5, when image information from a personal computer (PC) is input to the image processing unit 201 (step S1), dot data of a target line R(m), two lines of dot data before (ahead of) the target line R(m), and two lines of dot data after (behind) the target line R(m), are stored in line memories (step S2). Then, for the next operation, the address memory for the main scanning direction is initialized (step S3).

Next, it is detected as to whether there is dot data at the $n^{th}$ address in the line memory storing the target line R(m) (step S5). When the value stored at the $n^{th}$ address in the line memory is "0", i.e., there is no dot data (No in step S5), the exposure time is determined as 0% for the dot data of the pixel at the $n^{th}$ position in the main scanning direction in the target line R(m) (hereinafter, "target pixel"), and information of this exposure time is stored at the address (n, m) corresponding to the target pixel in the line memory (step S6). Incidentally, when forming an isolated one-dot image, the exposure time is 100%.

Meanwhile, when the value stored at address n is "1", i.e., dot data is stored (Yes in step S5), it is checked whether there is dot data at the $n^{th}$ address (n, m−1) in the line memory storing the line data R(m−1) corresponding to one line before the target line R(m) (step S7). When dot data is stored at this address (Yes at step S7), it is checked whether there is dot data at the $n^{th}$ address (n, m−2) in the line memory storing the line data R(m−2) corresponding to two lines before the target line R(m) (step S8). When dot data is stored at this address (Yes at step S8), it means that there are three continuous dot images in the sub scanning direction. Therefore, the exposure time is determined as 84% for the target pixel (dot) (step S9), and information of this exposure time is stored at the address (n, m) corresponding to the target pixel in the line memory.

Meanwhile, when there is no dot data at the address (n, m−2) (No at step S8), it is checked whether there is dot data at the $n^{th}$ address (n, m+1) in the line memory storing the line data R(m+1) corresponding to one line after the target line R(m) (step S10). When dot data is not stored at this address (No at step S10), it means that there are two continuous dot images in the sub scanning direction. Therefore, the exposure time is determined as 92% for the target pixel (dot) (step S12), and information of this exposure time is stored at the address (n, m) corresponding to the target pixel (dot) in the line memory.

When dot data is stored at the address (n, m+1) in the line memory (Yes at step S10), it means that there are three continuous dot images in the sub scanning direction. Therefore, the exposure time is determined as 84% for the target pixel (dot) (step S11), and information of this exposure time is stored at the address (n, m) corresponding to the target pixel (dot) in the line memory.

Meanwhile, when there is no dot data stored at the address (n, m−1) in the line memory (No at step S7), it is checked whether there is dot data stored at the address (n, m+1) in the line memory (step S13). When dot data is stored at the address (n, m+1) in the line memory (Yes at step S13), it is checked whether there is dot data stored at the address (n, m+2) in the line memory (step S14). When dot data is stored at the address (n, m+2) in the line memory (Yes at step S14), it means that there are three continuous dot images in the sub scanning direction. Therefore, the exposure time is determined as 84% for the target pixel (dot) (step S15), and information of this exposure time is stored at the address (n, m) corresponding to the target pixel (dot) in the line memory.

Meanwhile, when dot data is not stored at the address (n, m+2) in the line memory (No at step S14), it means that there are two continuous dot images in the sub scanning direction. Therefore, the exposure time is determined as 92% for the target pixel (dot) (step S16), and information of this exposure time is stored at the address (n, m) corresponding to the target pixel (dot) in the line memory.

When dot data is not stored at the address (n, m+1) in the line memory (No at step S13), it means that the target pixel (dot) is an isolated one-dot image. Therefore, the exposure time is determined as 100% for the target pixel (dot) (step S17), and information of this exposure time is stored at the address (n, m) corresponding to the target pixel (dot) in the line memory.

When the exposure time for the target pixel (dot) is determined by the above method, and the address n of the target pixel (dot) is not the last address ni in the line memory storing the target line R(m) (No at step S18), n is incremented by one (step S4), and procedures of step S5 and beyond are performed. Meanwhile, when the address n of the target pixel (dot) is the last address ni (Yes at step S18), the exposure time determining flow ends. This process is performed for all of the line data items, so that the exposure time for each pixel (dot) is determined.

Figure 7A:
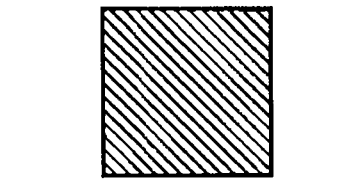
FIGS. 7A through 7C are diagrams for describing exposure timings in practical example 1.
Figure 7B:
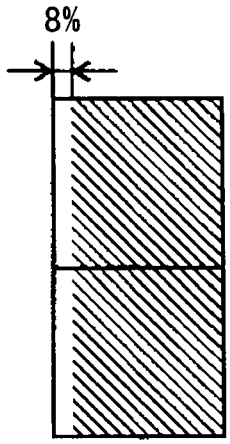
Figure 7C:
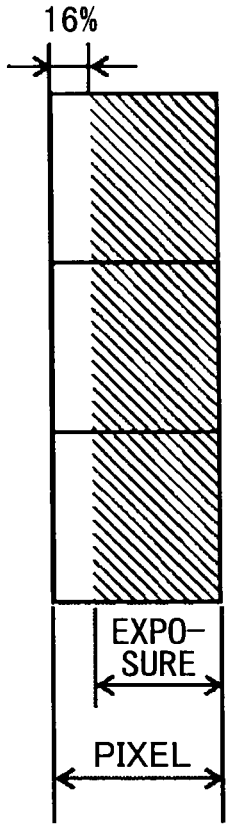

When the exposure time for each pixel (dot) is determined by the above process, exposure is performed as follows. For a dot image that does not have any dot images on either of its sides in the sub scanning direction, i.e., for an isolated dot image, the photoconductor surface is exposed to form the isolated dot image with full exposure as shown in FIG. 7A. As shown in FIG. 7B, when two dot images are continuously arranged in the sub scanning direction, the time of exposure for each dot image is reduced by 8% compared to the case of an isolated dot image. As shown in FIG. 7C, when three or more dot images are continuously arranged in the sub scanning direction, the time of exposure for each dot image is reduced by 16% compared to the case of an isolated dot image.

Figure 8:
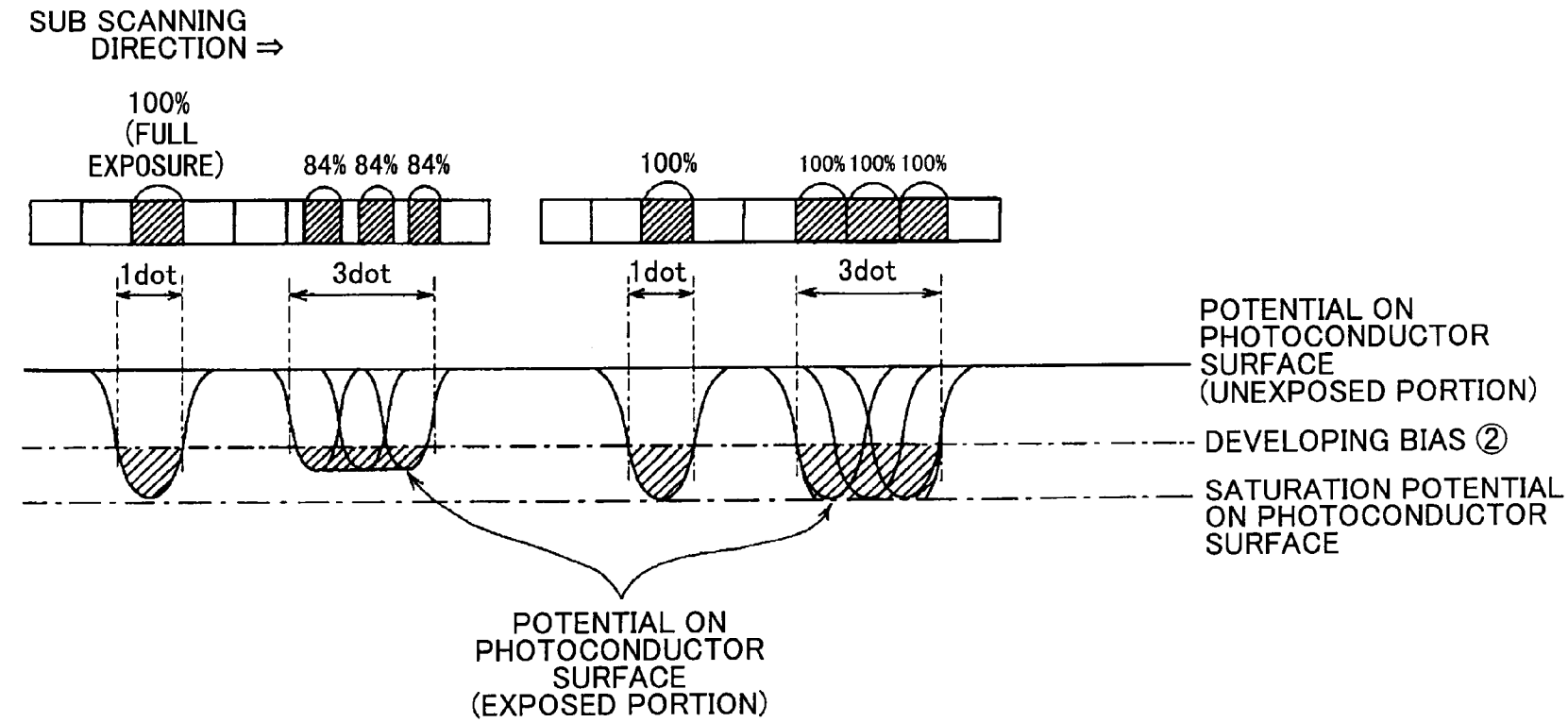
FIG. 8 illustrates potentials on a photoconductor surface, where (a) corresponds to practical example 1 and (b) corresponds to the conventional technology.

In FIG. 8, (a) illustrates the potential of exposed portions of the photoconductor in practical example 1 according to the present embodiment of the present invention. In FIG. 8, (b) illustrates the potential of exposed portions of the photoconductor in a conventional case where the exposure times are not changed (i.e., same as that for an isolated dot image) for dot images continuously arranged in the sub scanning direction.

In the case shown in (b) of FIG. 8, the exposure times are not changed for dot images continuously arranged in the sub scanning direction, and therefore the developing potential (the difference between the developing bias and the potential of exposed portions of the photoconductor surface) is large where three dot images are continuously arranged. As a result, a large amount of toner adheres to this portion. In the case shown in (a) of FIG. 8, at portions where dot images are continuously arranged, the exposure time for each dot image is reduced compared to that for an isolated dot image. Therefore, the exposure amount is reduced, and the width and depth of each beam spot is reduced on the photoconductor surface. Consequently, the developing potential is reduced where three dot images are continuously arranged, and the amount of adhering toner can be maintained at an optimum level.

Figure 4:
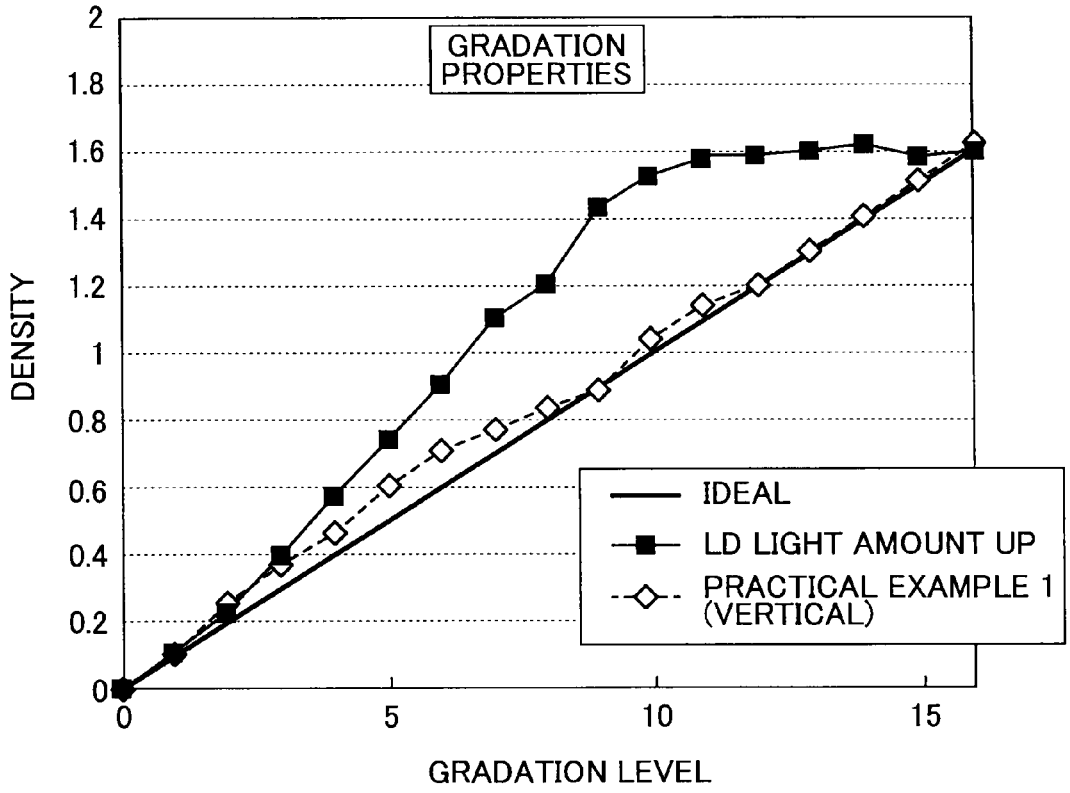
FIG. 4 is a graph indicating area gradation properties of practical example 1 and area gradation properties in a case where the developing bias is adjusted to attain favorable reproducibility of isolated one dot images.

As a result, as indicated by a line joining ◇ marks in the graph shown in FIG. 4, in practical example 1, isolated one-dot images are favorably reproduced, and the density of a solid image corresponding to the sixteenth gradation level is substantially near the ideal value. Accordingly, it can be observed that the area gradation properties are significantly improved compared to the conventional technology.

In practical example 1, when three or more dot images are continuously arranged, the exposure times for the dot images are uniformly reduced by 16% compared to the case of an isolated dot image. However, the present invention is not limited thereto. The exposure time can be reduced even more in accordance to the number of continuously arranged dots.

Practical Example 2

A description is given of practical example 2.

In practical example 1, the lengths of exposure times are uniformly reduced according to the number of continuous dot images; however, with such a configuration, the densities are somewhat higher than the ideal values at the fourth through seventh gradation levels, as shown in FIG. 4.

Accordingly, in practical example 2, in order to reduce excessive densities, the following findings have been obtained as a result of thorough research. That is, when there are dot images continuously arranged in the sub scanning direction, the exposure time of a dot image positioned in between dot images is to be shorter than those of the dot images positioned at both ends.

Figure 9:
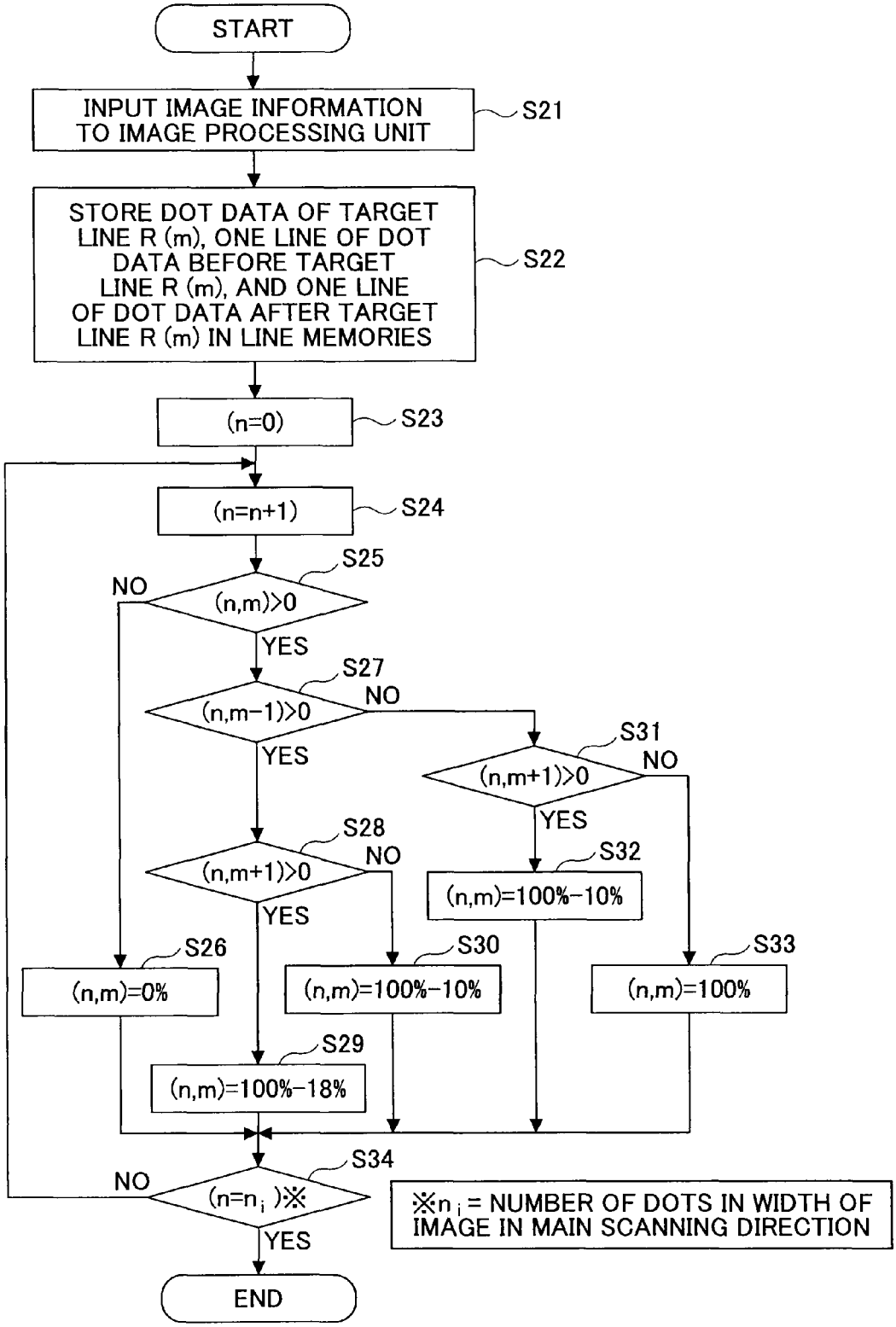
FIG. 9 is a control flowchart of procedures for determining the exposure time for each pixel (dot) according to practical example 2.
Figure 10:
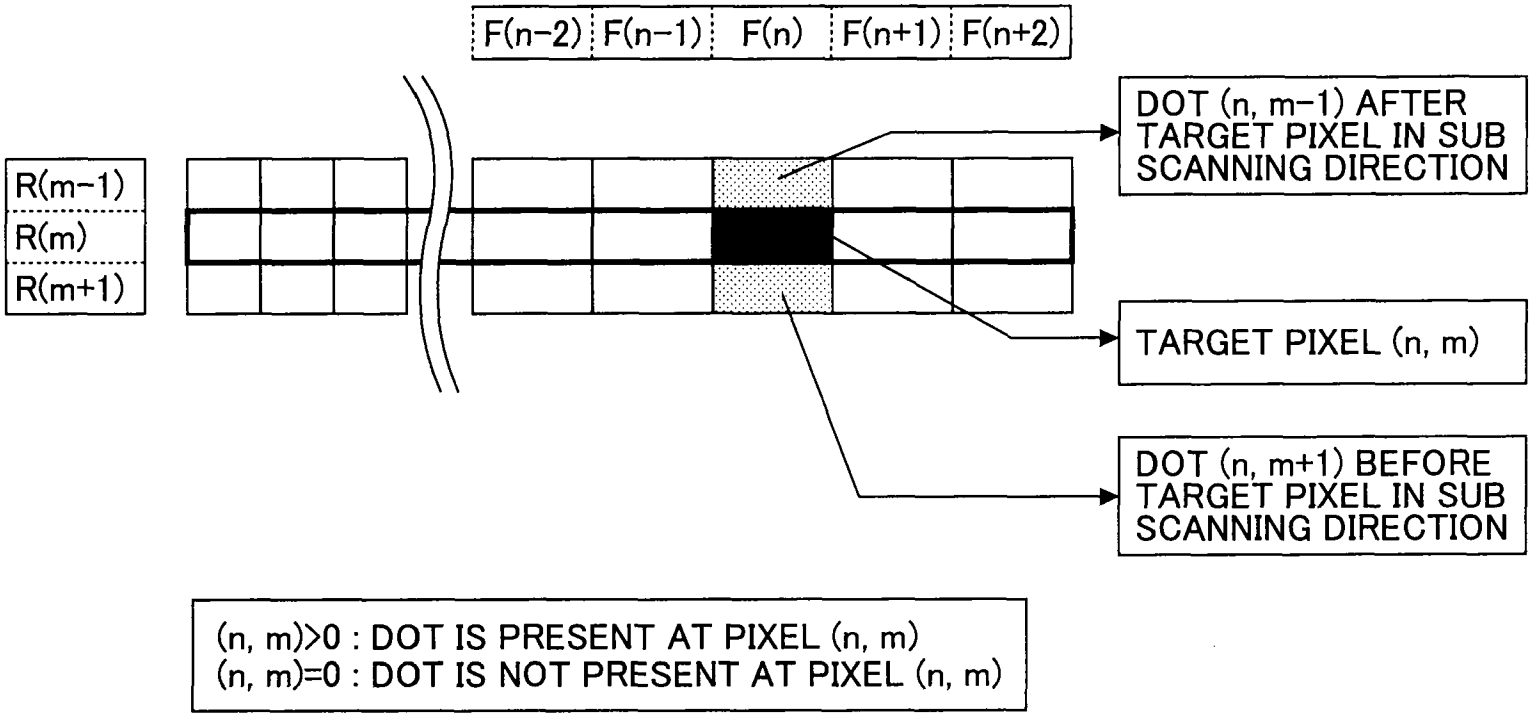
FIG. 10 illustrates the procedure of determining the exposure time for each pixel (dot) according to practical example 2.

FIG. 9 is a control flowchart of procedures for determining the exposure time for each pixel (dot) according to practical example 2. FIG. 10 illustrates the procedure of determining the exposure time for each pixel (dot) according to practical example 2.

As shown in FIG. 9, when image information from a personal computer (PC) is input to the image processing unit 201 (step S21), dot data of a target line R(m), one line of dot data before (ahead of) the target line R(m), and one line of dot data after (behind) the target line R(m), are stored in line memories (step S22). Then, for the next operation, the address memory for the main scanning direction is initialized (step S23). Next, it is detected as to whether there is dot data at the $n^{th}$ address in the line memory storing the target line R(m), as in practical example 1 (step S25). When there is no dot data (the value "0" is stored) (No in step S25), the exposure time is determined as 0% for the target pixel (dot), and information of this exposure time is stored at the address (n, m) corresponding to the target pixel in the line memory (step S26).

Meanwhile, when dot data is stored (the value "1" is stored) at the target pixel (n, m) (Yes in step S25), it is checked whether there is dot data at the address (n, m−1) in the line memory corresponding to the $n^{th}$ pixel (dot) in the main scanning direction in the line data at one line after the target pixel (n, m) (step S27). When dot data is stored at this address (n, m−1) (Yes at step S27), it is checked whether there is dot data at the address (n, m+1) in the line memory corresponding to the $n^{th}$ pixel (dot) in the main scanning direction in the line data at one line before the target pixel (n, m) (step S28). When dot data is stored at this address (n, m+1) (Yes at step S28), it means that the dot image of the target pixel is positioned between two dot images. Therefore, the exposure time is determined as 82%, and information of this exposure time is stored at the address (n, m) corresponding to the target pixel in the line memory (step S29).

Meanwhile, when there is no dot data at the address (n, m+1) (No at step S28), it means that the dot image of the target pixel is at the end of dot images continuously arranged in the sub scanning direction. Therefore, the exposure time is determined as 90%, and information of this exposure time is stored at the address (n, m) corresponding to the target pixel in the line memory (step S30).

When there is no dot data at the address (n, m−1) (No at step S27), but there is dot data at the address (n, m+1) (Yes at step S31), it means that the dot image of the target pixel is at the end of dot images continuously arranged in the sub scanning direction. Therefore, the exposure time is determined as 90%, and information of this exposure time is stored at the address (n, m) corresponding to the target pixel in the line memory (step S32).

Meanwhile, when there is no dot data at the address (n, m−1) or at the address (n, m+1) (No at step S27, No at step S31), it means that the dot image of the target pixel is an isolated one-dot image. Therefore, the exposure time is determined as 100%, and information of this exposure time is stored at the address (n, m) corresponding to the target pixel in the line memory (step S33).

When the exposure time for the target pixel (dot) is determined by the above method, and the address n of the target pixel is not the last address ni in the line memory storing the target line R(m) (No at step S34), n is incremented by one (step S24), and procedures of step S25 and beyond are performed. Meanwhile, when the address n of the target pixel is the last address ni (Yes at step S34), the exposure time determining flow ends.

Figure 11A:
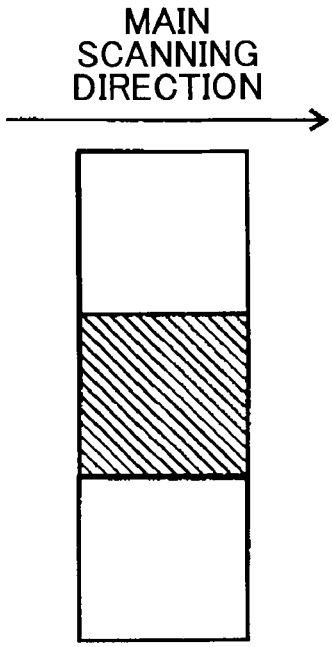
FIGS. 11A through 11C are diagrams for describing exposure timings in practical example 2.
Figure 11B:
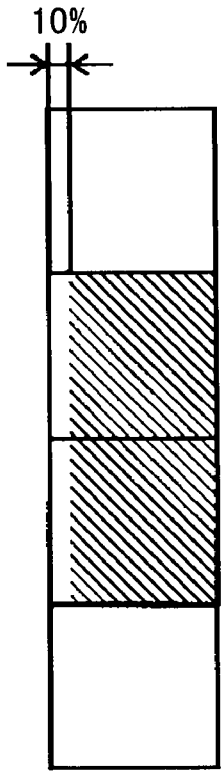
Figure 11C:
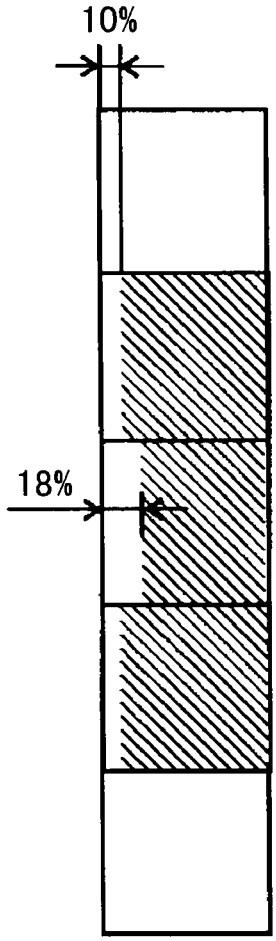

When the exposure time for each pixel (dot) is determined by the above process, exposure is performed as follows. As shown in FIG. 11B, when there are two continuous dot images, the printing time of each dot is reduced by 10% with respect to that of an isolated dot image. As shown in FIG. 11C, when there are three continuous dot images, the exposure time of a dot image positioned in between dot images is reduced by 18% with respect to that of an isolated dot image, while the exposure time of the dot images positioned at both ends is reduced by 10% with respect to that of an isolated dot image.

Figure 12:
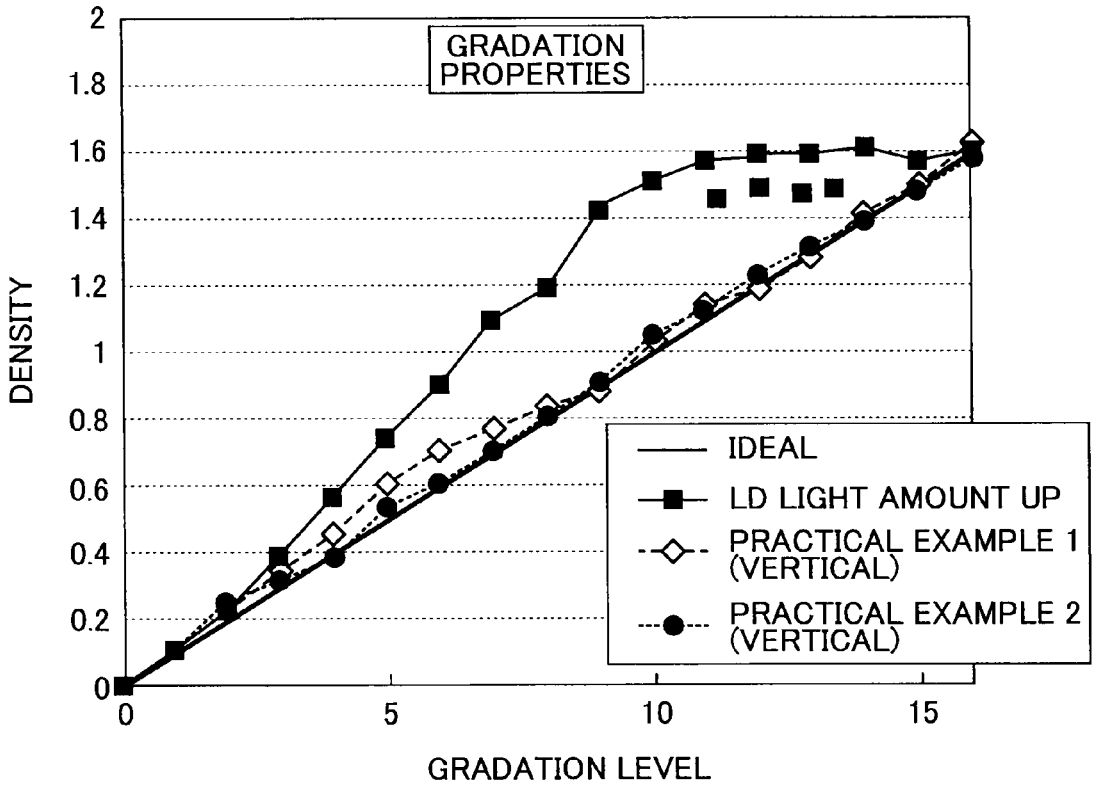
FIG. 12 is a graph indicating area gradation properties of practical example 1, area gradation properties of practical example 2, and area gradation properties in a case where the developing bias is adjusted to attain favorable reproducibility of isolated one dot images.

FIG. 12 is a graph indicating area gradation properties of practical example 1, area gradation properties of practical example 2, and area gradation properties in a case where the developing bias is adjusted to attain favorable reproducibility of isolated one dot images.

As shown in FIG. 12, in practical example 2, the excessive densities at the fourth through seventh gradation levels are reduced. Accordingly, the linearity is significantly improved compared to practical example 1, and the line is closer to the ideal line.

Practical Example 3

A description is given of practical example 3.

In practical examples 1 and 2, the exposure time is reduced by delaying the timing of starting exposure (timing of starting to emit light from a laser diode) for each pixel (dot). However, each of the dot images obtained by the exposure is not bilaterally-symmetric with respect to the center of the pixel (dot) in the main scanning direction. As a result, positional shift and color shift may occur, which would lead to image noise.

Accordingly, in practical example 3, the exposure timing for each dot image is controlled such that the dot images continuously arranged in the sub scanning direction become bilaterally-symmetric with respect to the center of the pixel (dot).

Figure 13A:
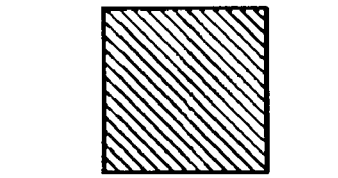
FIGS. 13A through 13C are diagrams for describing exposure timings in practical example 3.
Figure 13B:
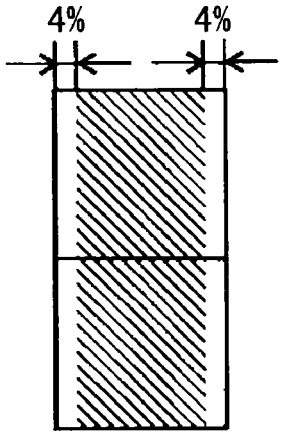
Figure 13C:
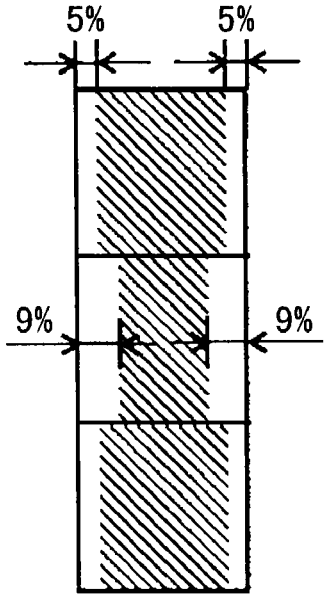

That is, when there are dot images continuously arranged in the sub scanning direction, the timings of starting exposure and ending exposure are adjusted so that each dot image is positioned at the center of the pixel (dot). Specifically, as shown in FIG. 13B, when there are two dot images continuously arranged in the sub scanning direction, and the exposure time is to be reduced by 8% with respect to full exposure, the timing of starting exposure (timing of starting to emit light from a laser diode) is delayed by 4% with respect to full exposure, and the timing of ending exposure (timing of stopping to emit light from the laser diode) is brought up by 4% with respect to full exposure. In a case where the exposure time of dot images situated on both ends of dot images continuously arranged in the sub scanning direction is to be reduced by 10%, and the exposure time of dot images situated between these end dot images in the sub scanning direction is to be reduced by 18%, the timing of starting exposure is delayed and the timing of ending exposure is brought up for each of these dot images, as shown in FIG. 13C.

As described in practical example 3, when there are dot images continuously arranged in the sub scanning direction, by controlling the starting/ending timings of exposure for each dot in such a manner that the dots become bilaterally-symmetric with respect to the center of the pixel (dot) in the main scanning direction, it is possible to prevent color shift and positional shift.

Practical Example 4

A description is given of practical example 4.

In the case of using a one-component developer, with the passage of time, the developer (toner) may become degraded and the toner charge amount may decrease. If the toner charge amount decreases, an increased amount of toner adheres to the photoconductor. As a result, the actual density becomes higher than the corresponding gradation level (the inclination of the line in the graph shown in FIG. 4 becomes steep), and may deviate from the ideal line. Accordingly, in practical example 4, a table such as Table 1 is stored in the memory of the apparatus, which indicates exposure time lengths according to the association between endurable numbers of sheets and numbers of dot images continuously arranged in the sub scanning direction. Based on this table, the exposure time is changed in accordance with the endurable number of sheets.

TABLE 1

| No. of continuous | Endurable number of sheets | | | | | |
|---|---|---|---|---|---|---|
| dots | 0 | 1000 | 2000 | 3000 | 4000 | 5000 |
| 1 dot | 100% | 100% | 100% | 100% | 100% | 100% |
| 2 dots | 90% | 89% | 88% | 87% | 86% | 85% |
| 3 or more dots | 82% | 81% | 80% | 79% | 78% | 77% |

In the case of practical example 4, the engine control unit 200 counts the number of sheets on which images have been formed (number of image-formed sheets), and the accumulated value is stored in the memory. When the exposure time for each pixel (dot) is to be determined, the number of image-formed sheets is read from the memory, and reference is made to the table to identify the exposure time corresponding to the number of image-formed sheets. When dot images are continuously arranged in the sub scanning direction, the exposure time found in the table is determined as the exposure time to be applied.

Accordingly, favorable area gradation properties can be maintained, without being degraded over time.

Practical Example 5

A description is given of practical example 5.

In practical example 5, the optical sensor 15, acting as the toner density detecting unit for detecting the toner density of a toner image on the intermediate transfer belt 1, is disposed as shown in FIG. 1. Based on the toner density detection results obtained by the optical sensor 15, the exposure time is determined for dot images continuously arranged in the sub scanning direction.

In practical example 5, when the number of image-formed sheets reaches a predetermined number or when the environment has changed by a predetermined amount, an exposure time changing mode is executed to make changes in the exposure times for dot images continuously arranged in the sub scanning direction.

First, the engine control unit 200 prints patch images corresponding to low density gradation levels through high density gradation levels onto the intermediate transfer belt 1. Then, the optical sensor 15 detects the patch images, and adjusts the developing bias in such a manner that the image density of each one-dot image becomes a predetermined image density. Accordingly, an isolated one-dot image, which has the lowest gradation level, can be made to have an ideal density.

Figure 14:
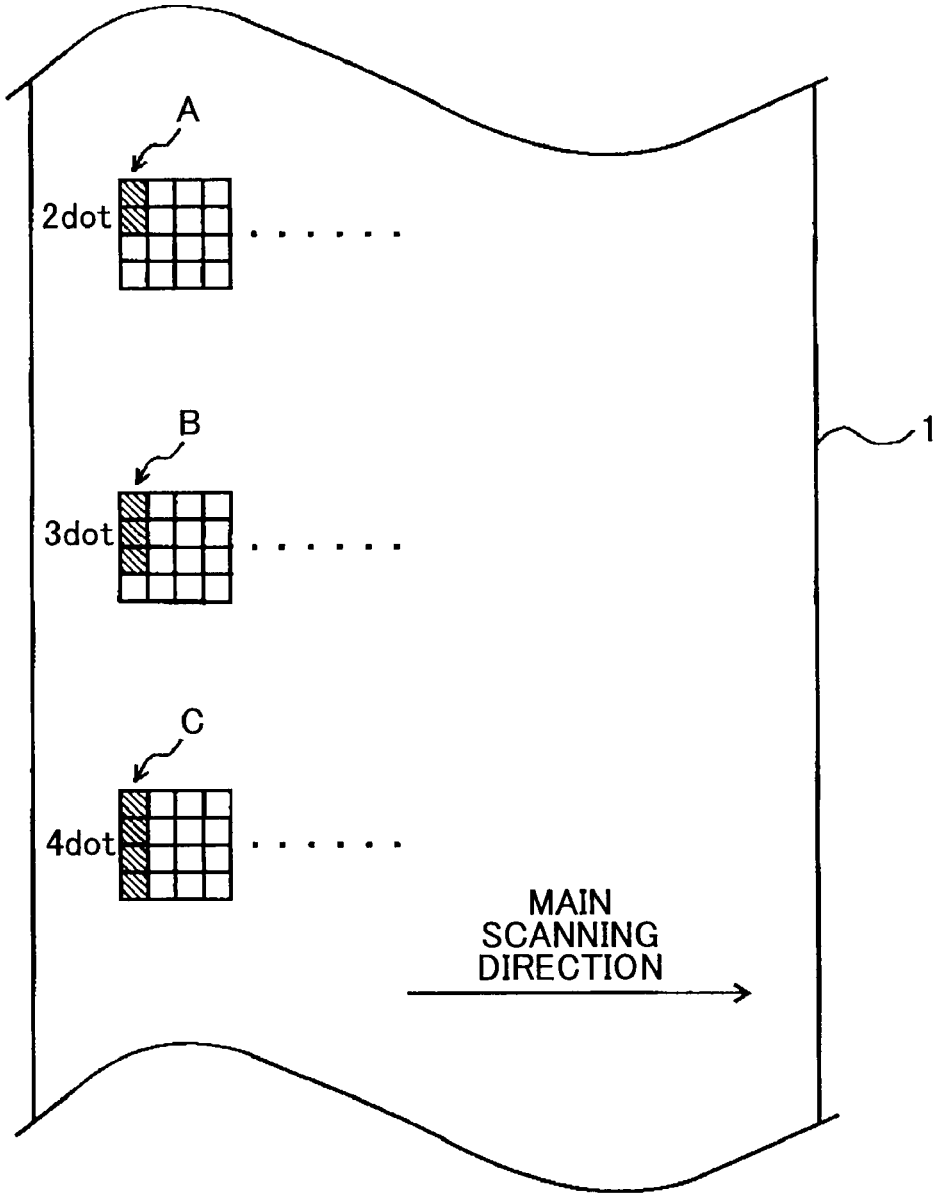
FIG. 14 illustrates examples of solid patch images formed on an intermediate transfer belt.
Figure 15:
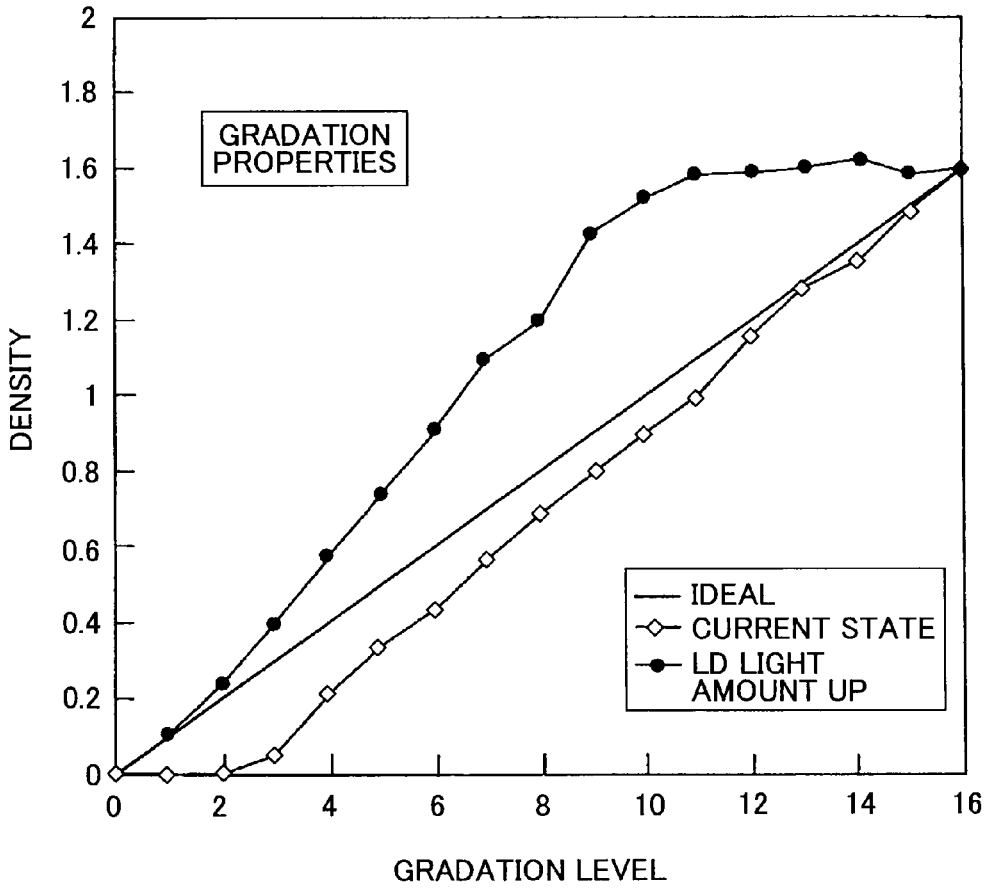
FIG. 15 is a graph indicating area gradation properties of the conventional technology and area gradation properties in a case where the LD light amount is increased.
Figure 16:
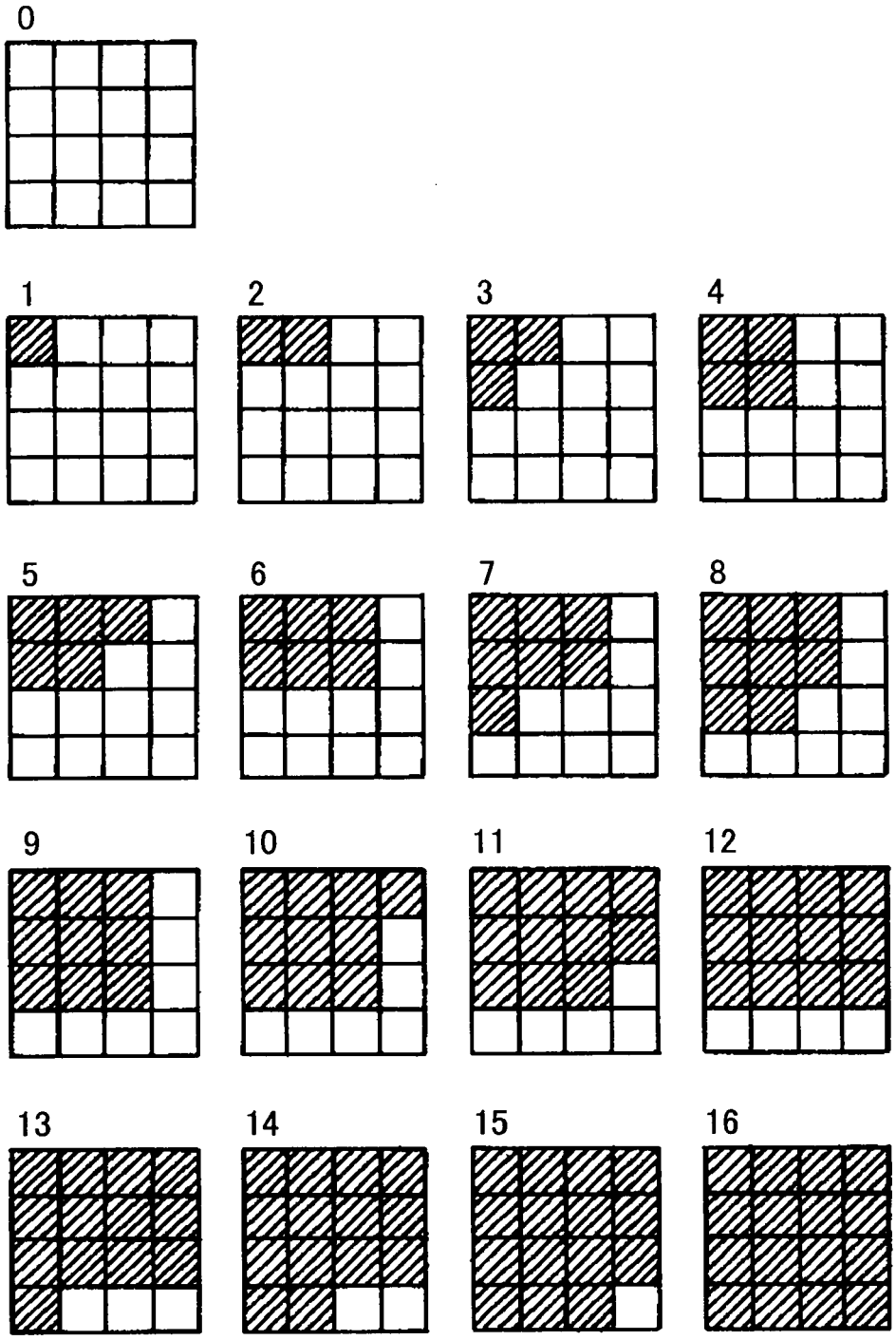
FIG. 16 is a diagram for describing area gradation.
Figure 17:
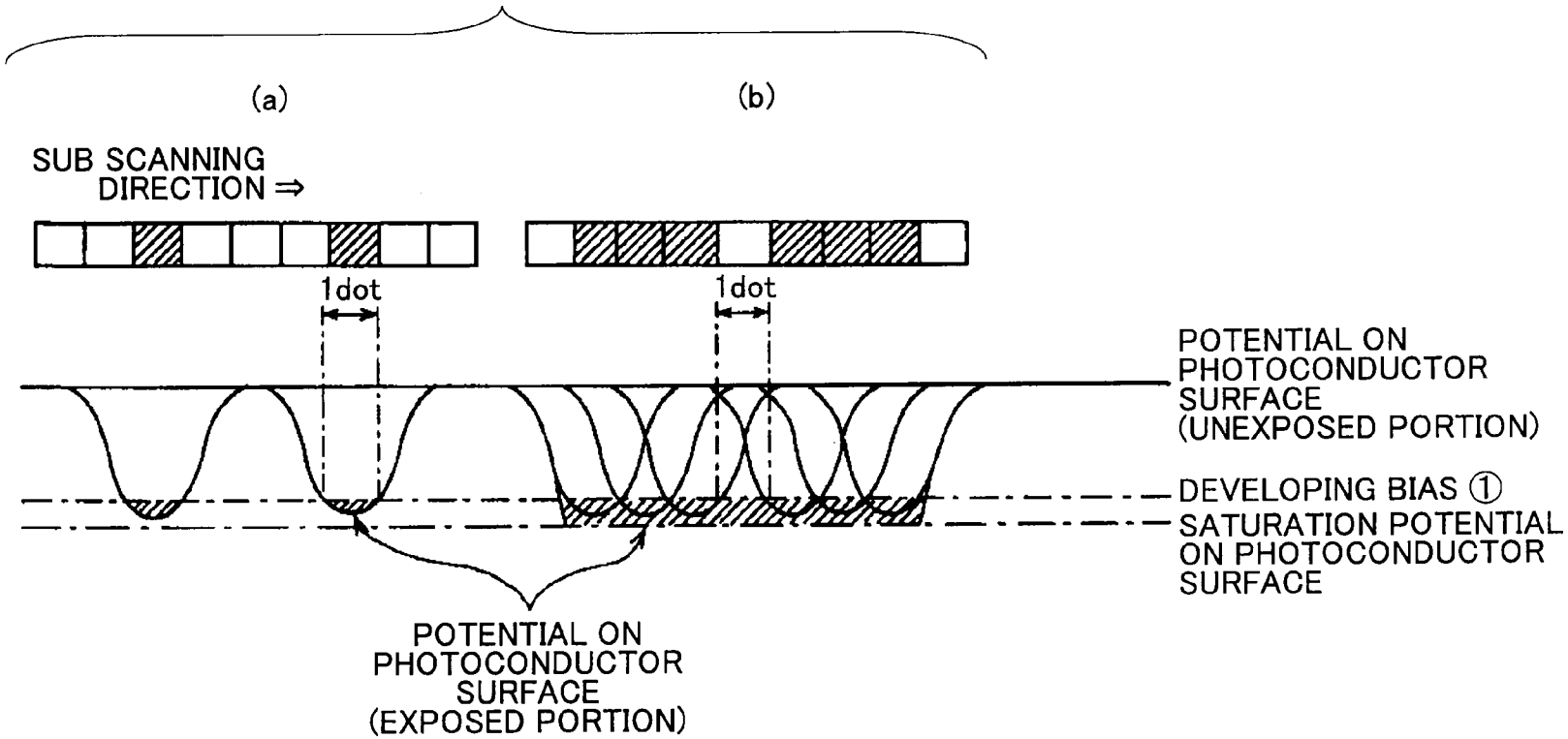
FIG. 17 illustrates potentials on a photoconductor surface, where (a) corresponds to a low density portion in the area gradation when the LD light amount is increased and (b) corresponds to a high density portion in the area gradation when the LD light amount is increased.
Figure 18:
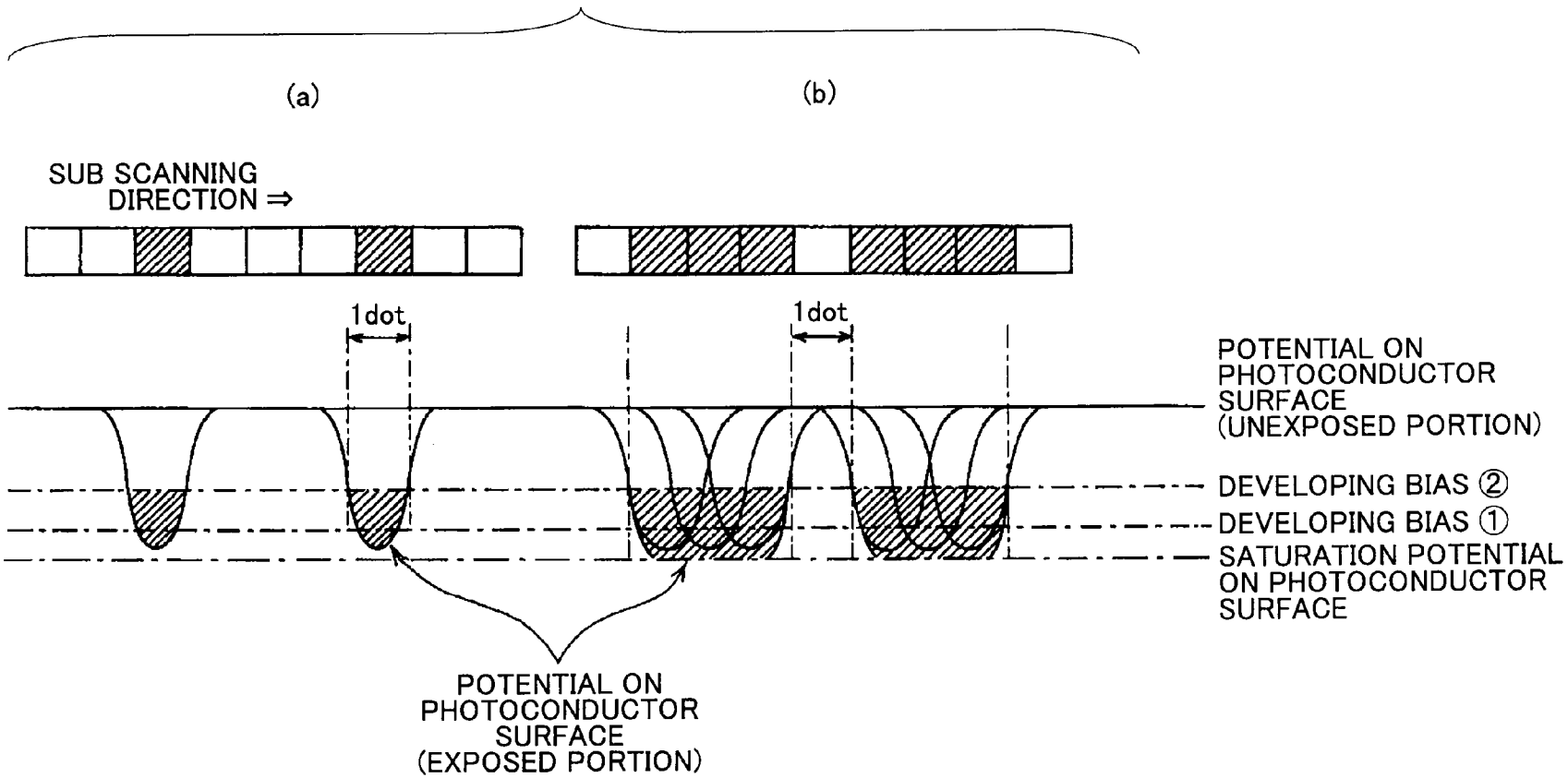
FIG. 18 illustrates potentials on a photoconductor surface, where (a) corresponds to a low density portion in the area gradation when the developing bias is adjusted for properly reproducing isolated one-dot images, and (b) corresponds to a high density portion in the area gradation when the developing bias is adjusted for properly reproducing isolated one-dot images.

In order to determine the developing bias which makes an isolated one-dot image have a predetermined density, solid images having different numbers of dots (pixels) continuously arranged in the sub scanning direction are formed on the surface of the photoconductor as shown in FIG. 14. In the present embodiment, the area gradation properties are expressed with a matrix of 4 dots×4 dots=16 dots. Hence, as for solid patch images, a solid patch image A including two continuous dots (pixels) in the sub scanning direction, a solid patch image B including three continuous dots (pixels) in the sub scanning direction, and a solid patch image C including four continuous dots (pixels) in the sub scanning direction are formed at predetermined intervals as shown in FIG. 14.

Next, these solid patch images A through C are transferred onto the intermediate transfer belt 1 and are detected by the optical sensor 15. Then, the exposure time, which is applied when there are two continuous dot (pixel) images, is changed so that the solid patch image A has a predetermined image density. Similarly, the exposure time, which is applied when there are three continuous dot (pixel) images, is changed so that the solid patch image B has a predetermined image density. The exposure time can be adjusted so that all three dots have the same exposure time as in practical example 1, or the exposure time can be adjusted so that the exposure time for the middle dot is different from that of each of the dots on both sides of the middle dot, as in practical example 2. Furthermore, the exposure time, which is applied when there are four continuous dot images, is changed so that the solid patch image C has a predetermined image density.

It is also possible to make adjustments as follows. That is, in order to determine the developing bias that makes an isolated one-dot image have a predetermined density, patch images corresponding to fourth through seventh gradation levels are formed. The exposure time applied when there are two continuous dot images in the sub scanning direction and the exposure time applied when there are three continuous dot images in the sub scanning direction are adjusted so that each of the image densities corresponding to the fourth through seventh gradation levels becomes the predetermined image density.

Furthermore, it is also possible to make the following adjustments. That is, color shift detection patches are formed for detecting color shift, and these color shift detection patches are detected by the optical sensor 15. Based on the detection results, as described in practical example 3, the timings for starting and ending exposure for continuously-arranged dot images are adjusted so that color shift is prevented.

Moreover, it is also possible to make adjustments by repeating the operations of adjusting the exposure time→creating patch images→detecting the image density, until an optimum density is attained. Furthermore, although the precision may decrease to some extent, the exposure time can be adjusted by referring to a table in order to reduce the amount of toner consumed and to reduce the time spent on making the adjustments.

In this case, a table is stored in the memory, which indicates exposure time correction amounts associated with the difference between patch image densities and optimum densities. The difference between the detection result obtained with the optical sensor 15 and the optimum density is calculated, and the exposure time correction amount is searched for and extracted from the table. This search-found exposure time is stored in the memory as the adjusted exposure time.

The exposure time applied when there are continuous dot images can be determined in consideration of dot image information in the main scanning direction. For example, when dot images continuously arranged in the sub scanning direction have adjacent pixels (dots) in the main scanning direction that are continuously arranged, the exposure time can be made shorter than that in the case where there are no adjacent pixels (dots) continuously arranged in the main scanning direction. If the exposed portions are superposed with potentials of surrounding exposed portions, the potential of the exposed portions decrease more than necessary, which increases the density of the exposed portions more than necessary. However, these disadvantages can be prevented by reducing the exposure time. Furthermore, for example, when a pixel (dot) adjacent to (in the main scanning direction) continuous dot images is a non-image dot that is surrounded by dot images (an isolated non-image dot), it is possible to adjust the exposure start timing or the exposure end timing for the dot images adjacent to the isolated non-image dot in the main scanning direction.

Furthermore, in the above description, the densities of isolated one-dot images are stabilized by adjusting the developing bias; however, an embodiment of the present invention is also applicable to a method of stabilizing densities of isolated one-dot images by intensifying the LD power.

An image forming apparatus according to an embodiment of the present invention includes a photoconductor acting as an image carrier; an exposing unit (optical writing unit) configured to expose a surface of the image carrier with exposure energy in accordance with pixels (dots) in image data to form an electrostatic latent image including dots; and a developing device acting as a developing unit configured to perform a developer contact developing method by applying a developing bias onto the developing roller 107 acting as a developer carrier carrying a non-magnetic one-component developer and causing the non-magnetic one-component developer on the developer carrier to contact the photoconductor, thereby developing the latent image on the photoconductor into a toner image. The toner image on the photoconductor is transferred onto a transfer sheet acting as a recording material, either directly or via a surface of an intermediate transfer belt acting as an intermediate transfer body, to form an image on the transfer sheet. The developing bias or the exposure energy is adjusted such that an isolated one-dot image has a predetermined image density. The image forming apparatus further includes a control unit configured to control the exposing unit in such a manner that, when the photoconductor is exposed to form the dot images continuously arranged in a sub scanning direction, the exposure time period is shorter than that when the photoconductor is exposed to form the isolated one-dot image.

As described above, the developing bias or the exposure energy is adjusted such that an isolated one-dot image has a predetermined image density, and therefore favorable gradation properties can be attained at low density portions in the area gradation. Furthermore, when the photoconductor is exposed to form dot images continuously arranged in the sub scanning direction, the exposure time and the exposure energy are reduced. As a result, it is possible to mitigate increases in densities in mid-density portions to high density portions in the area gradation, and to mitigate gradation loss (change) in the high density portions. Accordingly, favorable area gradation properties can be attained.

Furthermore, as described in practical example 2, when there are three or more dot images continuously arranged in the sub scanning direction, the control unit controls the exposure time period of exposing the photoconductor for forming a middle dot image which is positioned in between edge dot images, so as to be shorter than the exposure time period for forming the edge dot images. Accordingly, it is possible to reduce excessive densities at the fourth through seventh gradation levels, and therefore even more favorable area gradation properties can be attained.

Furthermore, as described in practical example 3, the control unit determines the exposure timing of exposing the photoconductor to form each of the dot images continuously arranged in the sub scanning direction such that the dot images continuously arranged in the sub scanning direction are bilaterally-symmetric with respect to a center portion of each pixel (dot) in the main scanning direction. Accordingly, the dot images continuously arranged in the sub scanning direction become bilaterally-symmetric with respect to a center portion of each pixel (dot) in the main scanning direction, thus mitigating image noise such as color shift and positional shift.

Furthermore, as described in practical example 4, there is provided a table of association between numbers of dot images continuously arranged in the sub scanning direction, and exposure time periods of exposing the image carrier to form respective dot images. The exposure time period is determined according to the table and the number of the dot images continuously arranged in the sub scanning direction. Accordingly, the exposure time period can be determined by referring to the table. Furthermore, the exposure time can be changed according to the endurable numbers of sheets, by providing a table of association between endurable numbers of sheets, the number of dot images continuously arranged in the sub scanning direction, and the exposure time.

Furthermore, as described in practical example 5, the optical sensor 15 acting as a toner density detecting unit is provided for detecting the toner density of the toner image on the photoconductor or the intermediate transfer belt. Patch images corresponding to detection toner images are formed, and the toner densities of the patch images are detected by the optical sensor 15. Based on these detection results, the exposure time period and/or the exposure timing of exposing the photoconductor with dot images continuously arranged in the sub scanning direction are determined. In this manner, images are actually formed, and based on results obtained from these images, the exposure time period and/or the exposure timing are determined. Accordingly, more favorable area gradation properties can be attained compared to the case of controlling the exposing operations based on exposure time periods and/or exposure timings determined beforehand.

Furthermore, there is provided a table of association between toner densities, numbers of dot images continuously arranged in the sub scanning direction in the toner image, and exposure time periods and/or exposure timings of exposing the image carrier to form respective ones of dot images. Accordingly, it is possible to determine an exposure time period and/or exposure timing of exposing the photoconductor to form dot images continuously arranged in the sub scanning direction based on the table, the toner density, and the number of dot images continuously arranged in the sub scanning direction in the toner image. Accordingly, the process of optimizing the exposure time period and/or exposure timing can be performed within a shorter time period compared to the method of determining the optimum exposure time period and/or exposure timing by repeating the operations of adjusting the exposure time period and/or exposure timing→creating a detection pattern→detecting the detection pattern, until the detection result obtained by detecting the detection pattern reaches a target value.

When the image carrier is exposed to form an isolated one-dot image, the image carrier is exposed with full exposure. Therefore, compared to a case of not forming the isolated one-dot image with full exposure, it is possible to mitigate losses in usage efficiencies of laser beams.

The exposure time period and/or exposure timing of exposing the photoconductor to form dot images continuously arranged in the sub scanning direction are determined according to the number of the dot images continuously arranged in the sub scanning direction and the number of dot images surrounding the dot images continuously arranged in the sub scanning direction. Accordingly, gradation loss (change) can be mitigated, and area graduation properties can be improved.

According to an aspect of the present invention, there is provided an image forming apparatus including an image carrier; an exposing unit configured to form an electrostatic latent image including dot images based on image data, by exposing a surface of the image carrier with exposure energy in accordance with pixels in the image data, wherein each of the dot images corresponds to one of the pixels; and a developing unit configured to perform a developer contact developing method by applying a developing bias onto a developer carrier carrying a non-magnetic one-component developer and causing the non-magnetic one-component developer on the developer carrier to contact the image carrier, thereby developing the electrostatic latent image on the image carrier into a toner image, wherein the toner image on the image carrier is transferred onto a recording material, either directly or via a surface of an intermediate transfer body; and the developing bias or the exposure energy is adjusted such that an isolated one-dot image has a predetermined image density, the image forming apparatus further including a control unit configured to control the exposing unit in such a manner that, when the image carrier is exposed to form the dot images which are continuously arranged in a sub scanning direction, an exposure time period for each of the dot images is shorter than a time period for exposing the image carrier to form the isolated one-dot image.

According to an aspect of the present invention, in the image forming apparatus, the control unit controls the exposing unit in such a manner that, when the image carrier is exposed to form three or more of the dot images continuously arranged in the sub scanning direction, the exposure time period for a middle dot image positioned in between edge dot images is shorter than that for each of the edge dot images.

According to an aspect of the present invention, in the image forming apparatus, the control unit determines an exposure timing of exposing the image carrier to form each of the dot images continuously arranged in the sub scanning direction, wherein the exposure timing is determined such that each of the dot images continuously arranged in the sub scanning direction is formed at a center position in a main scanning direction of the corresponding pixel.

According to an aspect of the present invention, the image forming apparatus further includes a table of association between numbers of the dot images continuously arranged in the sub scanning direction, and the exposure time periods of exposing the image carrier to form the respective dot images, wherein the exposure time period is determined according to the table and a number of the dot images continuously arranged in the sub scanning direction.

According to an aspect of the present invention, the image forming apparatus further includes a toner density detecting unit configured to detect a toner density of the toner image on the image carrier or on the intermediate transfer body, wherein a detection toner image is formed, the toner density of the detection toner image is detected by the toner density detecting unit, and the exposure time period of exposing the image carrier to form the respective dot images continuously arranged in the sub scanning direction is changed according to detection results obtained by the toner density detecting unit.

According to an aspect of the present invention, the image forming apparatus further includes a table of association between the toner densities, numbers of the dot images continuously arranged in the sub scanning direction in the toner image, and the exposure time periods of exposing the image carrier to form the respective dot images, wherein the exposure time period of exposing the image carrier to form each of the dot images continuously arranged in the sub scanning direction is changed according to the table, the toner density, and the number of the dot images continuously arranged in the sub scanning direction in the toner image.

According to an aspect of the present invention, in the image forming apparatus, the image carrier is exposed to form the isolated one-dot image with full exposure.

According to an aspect of the present invention, in the image forming apparatus, the exposure time period of exposing the image carrier to form each of the dot images continuously arranged in the sub scanning direction is determined according to a number of the dot images continuously arranged in the sub scanning direction and a number of the dot images surrounding the dot images continuously arranged in the sub scanning direction.

According to an aspect of the present invention, there is provided an image forming method including the steps of forming a latent image on a surface of an image carrier by exposing the surface of the image carrier based on input image data corresponding to dot images; and developing the latent image on the image carrier by performing a developer contact developing method with the use of a non-magnetic one-component developer, wherein when the image carrier is exposed to form the dot images continuously arranged in a sub scanning direction, an exposure time period is shorter than a time period for exposing the image carrier to form an isolated one-dot image.

According to the above aspects of the present invention, the following effects can be achieved by controlling the exposing unit in such a manner that, when the image carrier is exposed to form the dot images which are continuously arranged in a sub scanning direction, an exposure time period for each of the dot images is shorter than that for exposing the image carrier to form an isolated one-dot image. That is, the width of the latent image potential distribution will be reduced when the image carrier is exposed to form an isolated one-dot image. Accordingly, the latent image potentials of dot images continuously arranged in the sub scanning direction that are adjacent to the isolated non-image dot (on either side) are not overlapping each other. Furthermore, the potential at the non-image dot does not become as low as the potential of the exposed portions. Accordingly, it is possible to prevent the potential at the isolated non-image dot, which is located between dot images continuously arranged in the sub scanning direction, from attenuating down to the potential of the exposed portions as a result of being affected by the potentials of the dot images continuously arranged in the sub scanning direction on the image carrier which are adjacent to the isolated non-image dot (on either side).

Furthermore, as the exposure time period is short for forming each of the dot images continuously arranged in the sub scanning direction, the potentials of dot images continuously arranged in the sub scanning direction on the image carrier can be prevented from attenuating significantly. Therefore, the developing potential can be prevented from increasing. Accordingly, the image density can be prevented from increasing in dot images continuously arranged in the sub scanning direction on the image carrier. As a result, mid-density portions to high density portions in the area gradation, where there are many dot images continuously arranged in the sub scanning direction, can have a density that is close to an ideal density, thereby improving area gradation properties.

As described above, by reducing the exposure energy for forming dot images continuously arranged in the sub scanning direction, the density of mid-density portions to high density portions in the area gradation can be prevented from increasing, thereby preventing gradation loss (change) in high density portions. Furthermore, the developing bias or exposure energy is adjusted such that an isolated one-dot image has a predetermined density, and therefore favorable gradation properties can be attained for low-density portions in the area gradation. Thus, favorable area gradation properties can be attained.

The present invention is not limited to the specifically disclosed embodiment, and variations and modifications may be made without departing from the scope of the present invention.

The present application is based on Japanese Priority Patent Application No. 2008-002109, filed on Jan. 9, 2008, the entire contents of which are hereby incorporated herein by reference.

What is claimed is:

1. An image forming apparatus comprising:

an image carrier;

an exposing unit configured to form an electrostatic latent image including dot images based on image data, by exposing a surface of the image carrier with exposure energy in accordance with pixels in the image data, wherein each of the dot images corresponds to one of the pixels; and a developing unit configured to perform a developer contact developing method by applying a developing bias onto a developer carrier carrying a non-magnetic one-component developer and causing the non-magnetic one-component developer on the developer carrier to contact the image carrier, thereby developing the electrostatic latent image on the image carrier into a toner image, wherein the image carrier is configured to transfer the toner image onto a recording material; and the developing bias or the exposure energy is configured to be adjusted such that an isolated one-dot image has a predetermined image density, the image forming apparatus further comprising:

a control unit configured to control the exposing unit to provide, when the image carrier is exposed to form dot images which are continuously arranged in a sub scanning direction, an exposure time period for each of the continuously arranged dot images shorter than a time period for exposing the image carrier to form an isolated one-dot image, and among the continuously arranged dot images an exposure time period for an inner dot image positioned in between adjacent dot images is shorter than that for each of the adjacent dot images.

2. The image forming apparatus according to claim 1, wherein the control unit controls the exposing unit in such a manner that, when the image carrier is exposed to form three or more of the dot images continuously arranged in the sub scanning direction, the exposure time period for a middle dot image positioned in between edge dot images is shorter than that for each of the edge dot images.

3. The image forming apparatus according to claim 1, wherein the control unit determines an exposure timing of exposing the image carrier to form each of the dot images continuously arranged in the sub scanning direction, wherein the exposure timing is determined such that each of the dot images continuously arranged in the sub scanning direction is formed at a center position in a main scanning direction of the corresponding pixel.

4. The image forming apparatus according to claim 1, further comprising:

a storing unit which stores a table of association between numbers of the dot images continuously arranged in the sub scanning direction, and the exposure time periods of exposing the image carrier to form the respective dot images, wherein the exposure time period is determined according to the table and a number of the dot images continuously arranged in the sub scanning direction.

5. The image forming apparatus according to claim 1, further comprising:

a toner density detecting unit configured to detect a toner density of the toner image on the image carrier or on the intermediate transfer body, wherein a detection toner image is formed, the toner density of the detection toner image is detected by the toner density detecting unit, and the exposure time period of exposing the image carrier to form the respective dot images continuously arranged in the sub scanning direction is changed according to detection results obtained by the toner density detecting unit.

6. The image forming apparatus according to claim 5, further comprising:

a storing unit configured to store a table of association between the toner densities, numbers of the dot images continuously arranged in the sub scanning direction in the toner image, and the exposure time periods of exposing the image carrier to form the respective dot images, wherein the exposure time period of exposing the image carrier to form each of the dot images continuously arranged in the sub scanning direction is changed according to the table, the toner density, and the number of the dot images continuously arranged in the sub scanning direction in the toner image.

7. The image forming apparatus according to claim 1, wherein the image carrier is configured to be exposed to form the isolated one-dot image with full exposure.

8. The image forming apparatus according to claim 1, wherein the exposure time period of exposing the image carrier to form each of the dot images continuously arranged in the sub scanning direction is determined according to a number of the dot images continuously arranged in the sub scanning direction and a number of the dot images surrounding the dot images continuously arranged in the sub scanning direction.

9. An image forming method, implemented on an image forming apparatus, comprising:

forming a latent image on a surface of an image carrier by exposing the surface of the image carrier based on input image data corresponding to dot images; and developing the latent image on the image carrier by performing a developer contact developing method with the use of a non-magnetic one-component developer, wherein when the image carrier is exposed to form dot images continuously arranged in a sub scanning direction, an exposure time period is shorter than a time period for exposing the image carrier to form an isolated one-dot image and among the continuously arranged dot images, an exposure time period for an inner dot image positioned in between adjacent dot images is shorter than that for each of the adjacent dot images.

* * * * *